US009538825B2

(12) United States Patent
Yamasaki

(10) Patent No.: US 9,538,825 B2
(45) Date of Patent: Jan. 10, 2017

(54) DRAWING APPARATUS FOR HIGHLY ACCURATE DRAWING ON FINGER AND TOE NAILS

(71) Applicant: CASIO COMPUTER CO., LTD., Shibuya-ku (JP)

(72) Inventor: Shuichi Yamasaki, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/600,807

(22) Filed: Jan. 20, 2015

(65) Prior Publication Data

US 2015/0201734 A1 Jul. 23, 2015

(30) Foreign Application Priority Data

Jan. 20, 2014 (JP) ..... 2014-007391

(51) Int. Cl.
*A45D 34/04* (2006.01)
*A45D 29/00* (2006.01)

(52) U.S. Cl.
CPC ..... *A45D 34/04* (2013.01); *A45D 29/00* (2013.01); *A45D 2029/005* (2013.01)

(58) Field of Classification Search
CPC ... A45D 34/04; A45D 29/00; A45D 2029/005
See application file for complete search history.

(56) References Cited

U.S. PATENT DOCUMENTS 2,711,810 A * 6/1955 Greenspan ..... B41J 29/28 400/18
4,299,031 A * 11/1981 Collins ..... G06K 15/22 101/193
4,441,109 A * 4/1984 Fujisawa ..... B41J 2/49 346/139 R
4,527,176 A * 7/1985 Fujiwara ..... B41J 2/49 346/141
6,286,517 B1 * 9/2001 Weber ..... A45D 29/00 132/200
2004/0027415 A1 * 2/2004 Yamashita ..... B41J 2/165 347/37
2007/0274764 A1 * 11/2007 Shim ..... A45D 34/04 401/108
2009/0167817 A1 * 7/2009 Orr ..... B41J 3/4073 347/37

FOREIGN PATENT DOCUMENTS

JP 2003-534083 11/2003

* cited by examiner

*Primary Examiner* — Bradley Thies
(74) *Attorney, Agent, or Firm* — Cozen O'Connor

(57) ABSTRACT

A drawing apparatus, including a placement section including a placement surface on which a printing target object having a printing target surface that curved along one direction is placed, a drawing head in which at least one drawing tool having a tip portion at one end thereof is loaded and performs drawing by making the tip portion contact with a drawing position of the printing target surface, the tip portion having a shape including a first axis as a central axis; and a control unit which tilts the first axis of the tip portion to one of a first tilt direction and a second tilt direction selectively according to the drawing position of the printing target surface.

11 Claims, 10 Drawing Sheets

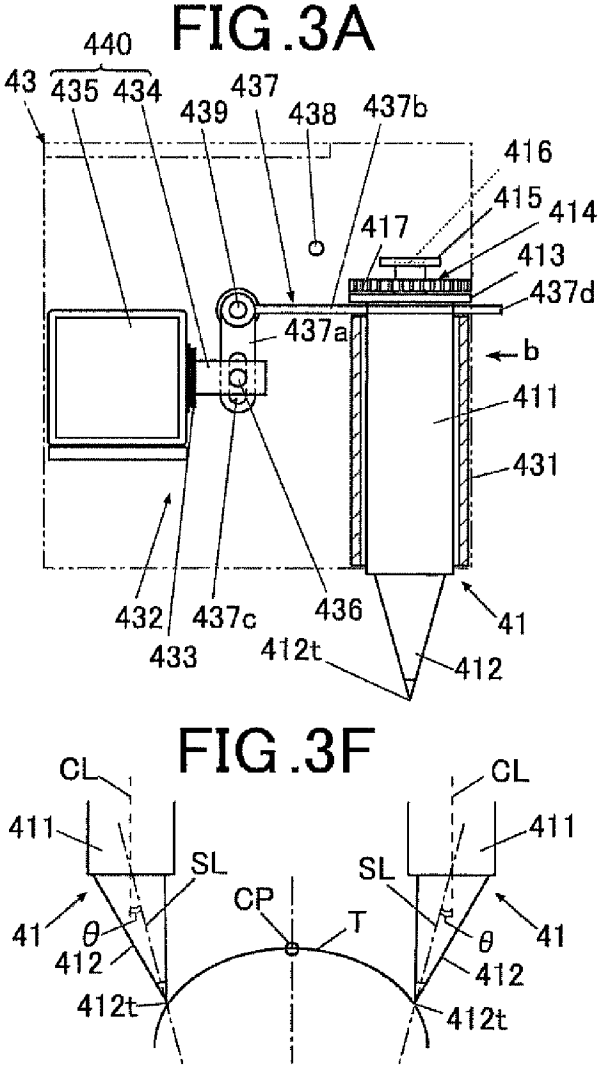
FIG.3A
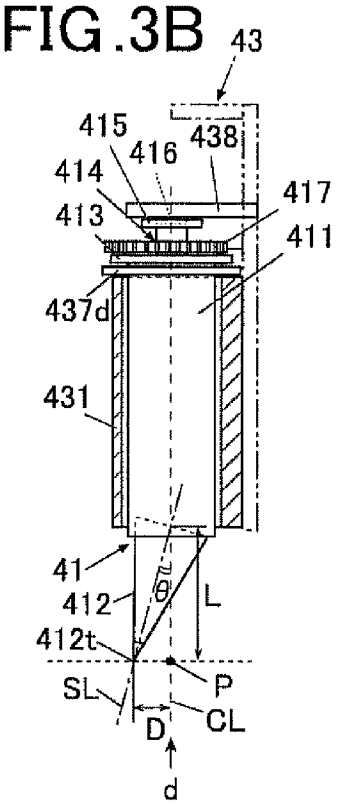
FIG.3B
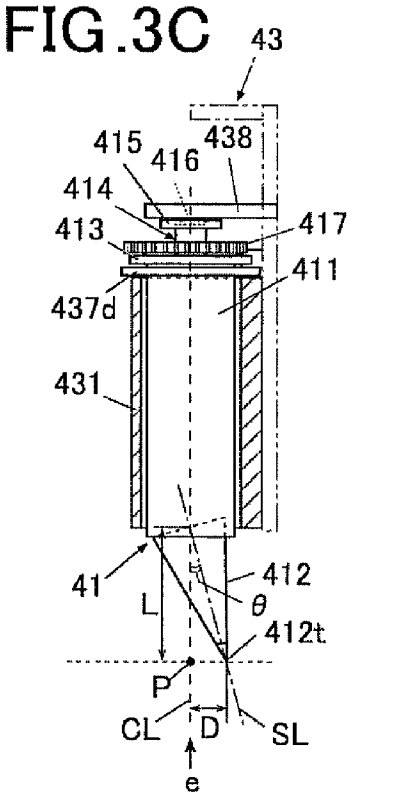
FIG.3C
FIG.3D
FIG.3E
FIG.3F

DRAWING APPARATUS FOR HIGHLY ACCURATE DRAWING ON FINGER AND TOE NAILS

CROSS-REFERENCE TO RELATED APPLICATIONS

The entire disclosure of Japanese Patent Application No. 2014-007391 filed on Jan. 20, 2014 including description, claims, drawings, and abstract are incorporated herein by reference in its entirety.

BACKGROUND OF THE INVENTION

1. Field of the Invention

The present invention relates to a drawing apparatus and a drawing control method thereof.

2. Description of Related Art

Conventionally, there have been known nail print apparatuses which perform nail printing by printing nail designs on nails. Such nail print apparatuses are described in Japanese Unexamined Patent Application Publication No. 2003-534083, for example.

By using such nail print apparatuses, nail designs can be enjoyed casually without visiting nail salons and such like.

The nail print apparatus described in the above document uses an ink-jet system which makes ink be in the form of micro droplets and sprays the ink droplets from a print head.

On the other hand, there have been known plot type drawing apparatuses which include writing tools (pens) for drawing and perform drawing by making pen tips which are tip portions of the writing tools contact drawing targets.

Since such plot type drawing apparatuses use pens, it is possible to use various types of ink which is difficult to use in the ink jet system, such as ink including pigment (color material) with a large particle diameter, lame and such like, ink with high viscosity and such like. Thus, in a case where such drawing apparatus is adopted as a nail print apparatus, it is possible to achieve nail print having a finish close to nail art provided at nail salons or the like.

However, nails which are drawing targets for the nail print apparatuses generally have curved shapes that the central portions in the width direction are high and relatively flat and the portions closer to the both ends in the width direction are lower and slanted more.

Thus, in a case where the writing tool has a felt-like pen tip, when drawing is performed for each of the end portions in the width direction of a nail which are largely slanted, a side of the pen tip sometimes contacts the nail to make the drawing line thicker. Alternatively, in a case where the writing tool has a ballpoint pen type pen tip, when drawing is performed for each of the end portions in the width direction of a nail, the ball part which is a tip of the pen tip is difficult to contact the nail surface to make the line blur or broken, and the drawing cannot be performed successfully.

For the above reasons, the finish quality of nail print is deteriorated at both end portions in the width direction of the nail in some cases.

SUMMARY OF THE INVENTION

An object of the present invention is to provide a drawing apparatus and a drawing control method thereof that can perform highly accurate nail printing even for end portions of nails having slant shape.

In order to solve the above object, according to one aspect of the present invention, there is provided a drawing apparatus, including: a placement section including a placement surface on which a printing target object having a printing target surface that curved along one direction is placed, a drawing head in which at least one drawing tool having a tip portion at one end thereof is loaded and performs drawing by making the tip portion contact with a drawing position of the printing target surface of the printing target object which is placed on the placement surface, the tip portion having a shape including a first axis as a central axis; and a control unit which tilts the first axis of the tip portion of the drawing tool loaded in the drawing head to one of a first tilt direction and a second tilt direction selectively according to the drawing position of the printing target surface, the first tilt direction being a direction that tilted from a vertical direction orthogonal to the placement surface to one side of the one direction and the second tilt direction being a direction that tilted from the vertical direction to another side of the one direction.

According to another aspect of the present invention, there is provided a drawing control method of a drawing apparatus, wherein the drawing apparatus includes a placement section including a placement surface on which a printing target object having a printing target surface that curved along one direction is placed, and a drawing head in which at least one drawing tool having a tip portion at one end thereof is loaded and performs drawing by making the tip portion contact with a drawing position of the printing target surface of the printing target object which is placed on the placement surface, a the tip portion having a shape including a first axis as a central axis, the method including: tilting the first axis of the tip portion of the drawing tool loaded in the drawing head to one of a first tilt direction and a second tilt direction selectively according to the drawing position of the printing target surface, the first tilt direction being a direction that tilted from a vertical direction orthogonal to the placement surface to one side of the one direction and the second tilt direction being a direction that tilted from the vertical direction to another side of the one direction.

BRIEF DESCRIPTION OF THE DRAWINGS

The above and other objects, advantages and features of the present invention will become more fully understood from the detailed description given hereinafter and the appended drawings which are given by way of illustration only, and thus are not intended as a definition of the limits of the present invention, and wherein:

FIG. 3A is an enlarged view of a pen carriage and a pen supported thereby in a drawing state and is a lateral view of the pen carriage and the pen;

FIG. 3B is an enlarged view of the pen carriage and the pen supported thereby in the drawing state and is a front view of the pen carriage and the pen in FIG. 3A seen from the arrow b direction;

FIG. 3C is an enlarged view of the pen carriage and the pen supported thereby in the drawing state and is a front view of the pen carriage and the pen in FIG. 3A seen from the arrow b direction;

FIG. 3D is a bottom view of the pen carriage and the pen in FIG. 3B seen from the arrow d direction;

FIG. 3E is a bottom view of the pen carriage and the pen in FIG. 3C seen from the arrow e direction;

FIG. 3F is a view showing a state in which the drawing portion of the pen tip of the pen contacts a nail when drawing is performed on the nail;

DETAILED DESCRIPTION OF THE PREFERRED EMBODIMENT

Figure 1:
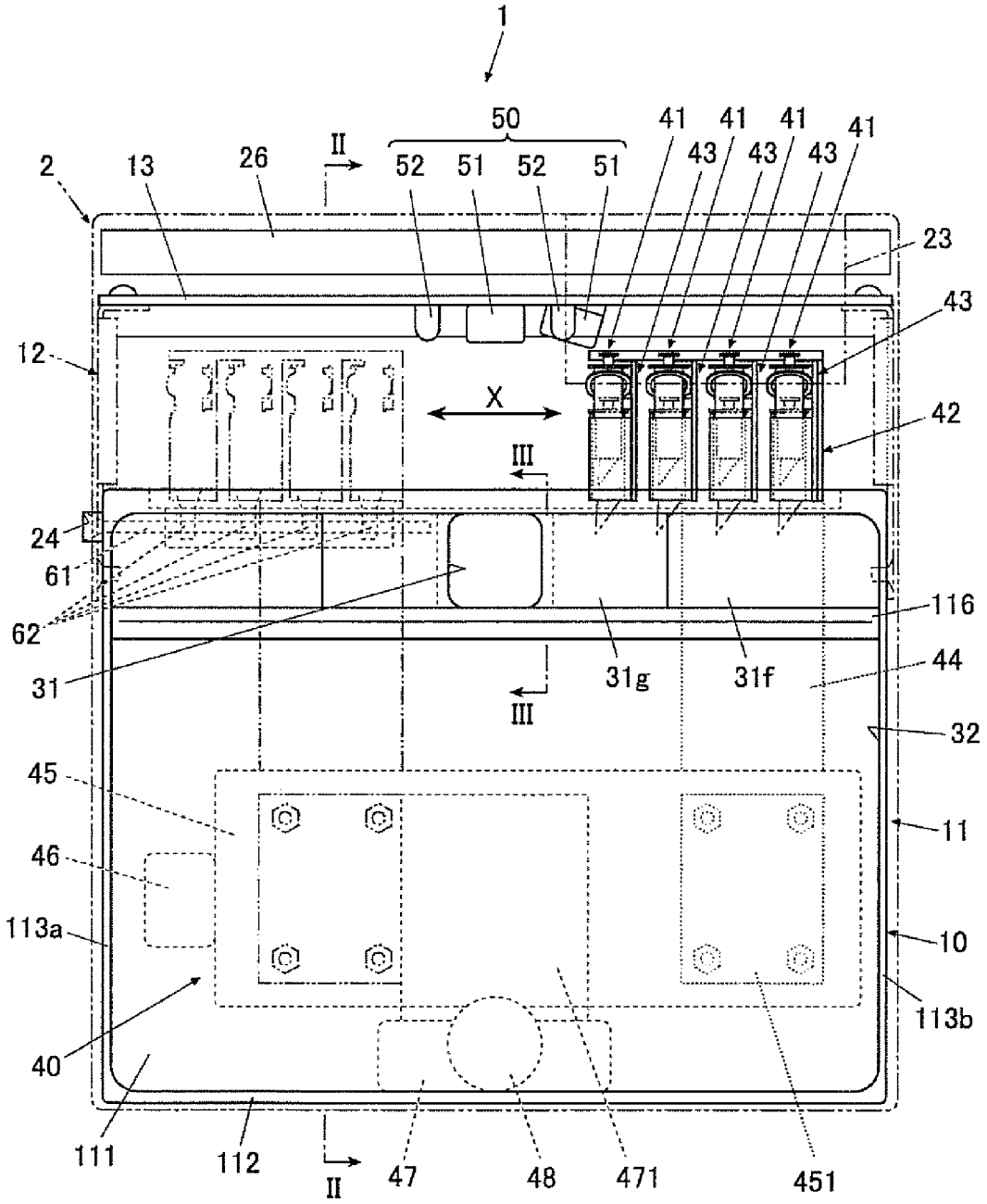
FIG. 1 is a front view of a nail print apparatus in a first embodiment.

Hereinafter, embodiments of a drawing apparatus and a drawing control method thereof according to the present invention will be described in detail by showing the drawings.

Though the after-mentioned embodiments are provided with various technically preferred limitations to perform the present invention, the scope of the present invention is not limited to the following embodiments and illustrated examples.

In the following embodiments, the drawing apparatus performs drawing on a surface of a fingernail of a hand as a drawing target surface. However, the drawing target surface of the present invention is not limited to the surface of the fingernail of hand. The drawing target surface may be a surface of a nail of a toe, for example.

[First Embodiment]

With reference to FIGS. 1 to 6, a first embodiment of a nail print apparatus (drawing apparatus) 1 according to the present invention will be described.

The nail print apparatus in the embodiment performs drawing on a drawing target surface that is a surface of a nail of a finger having a curved shape with the central portion raised compared to the both ends along the horizontal direction that is the width direction.

FIG. 1 is a front view of the nail print apparatus.

Figure 2B:
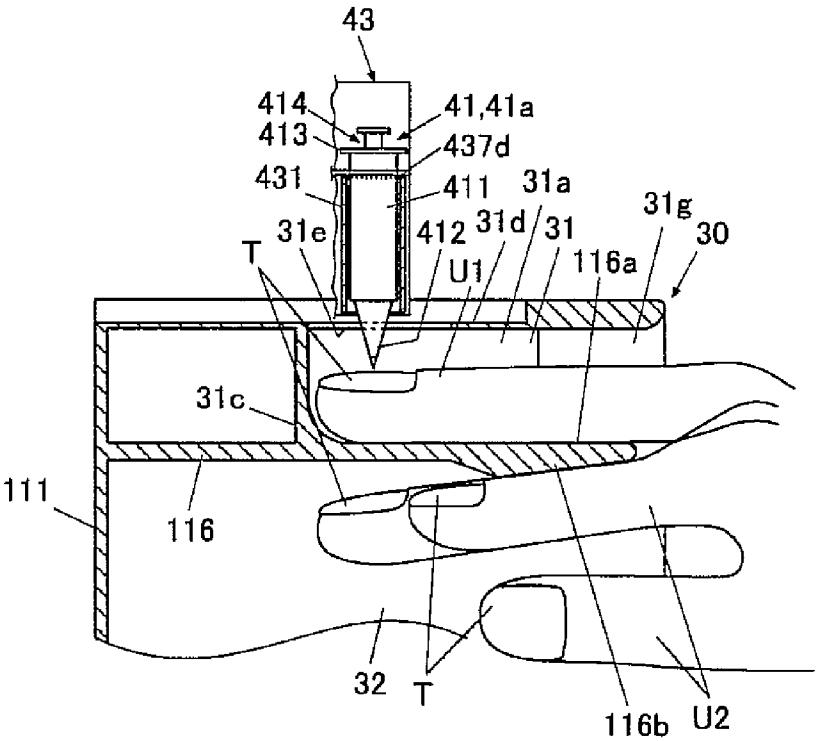
FIG. 2B is a sectional view along the line in FIG. 1.
Figure 2A:
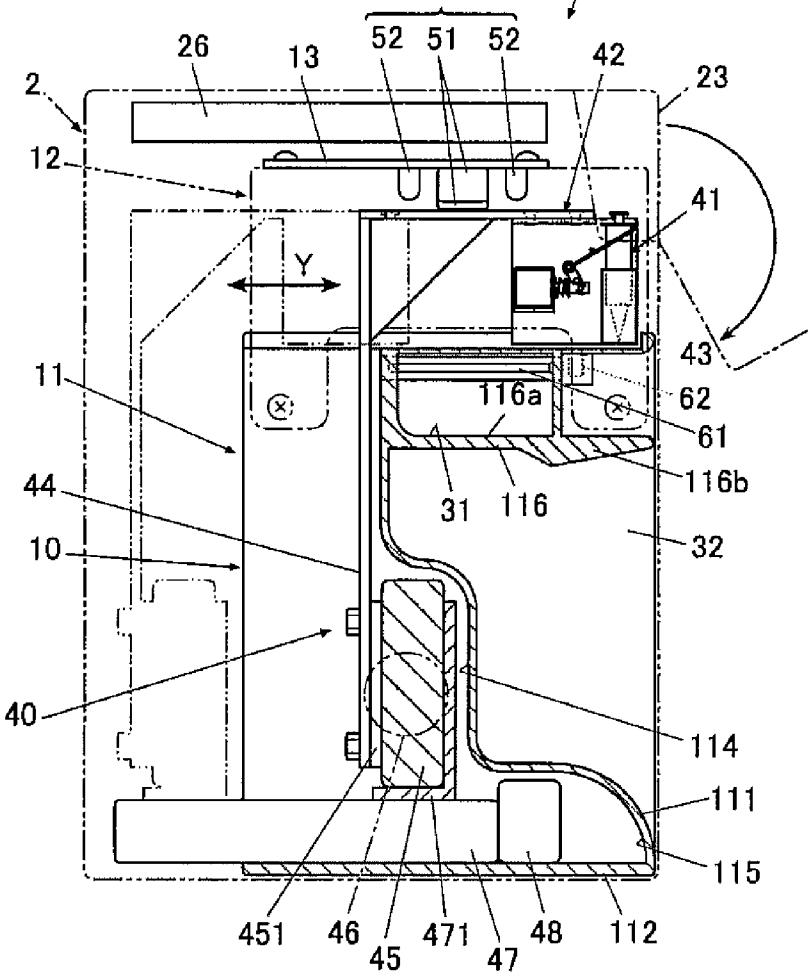
FIG. 2A is a lateral sectional view along the line II-II in FIG. 1.

FIG. 2A is a lateral sectional view of the nail print apparatus in FIG. 1 along the line II-II.

As shown in FIGS. 1 and 2A, the nail print apparatus (drawing apparatus) 1 includes a case main body 2 and an apparatus main body 10 contained in the case main body 2.

In FIGS. 1 and 2A, the case main body 2 is shown by a two-dot chain line.

A pen replacement cover 23 which is configured to be openable and closable for replacing an after-mentioned pen (writing tool) 41 in a drawing unit 40 is provided at an end of the upper section on the front surface of the case main body 2.

The pen replacement cover 23 is rotatable from a closed state to an open state via a hinge or the like as shown in FIG. 2A, for example.

Further, at the position on a lateral surface (left lateral surface in FIG. 1 in the embodiment) of the case main body 2 corresponding to an after-mentioned pen test writing unit 61, there is provided a medium inserting port 24 through which a drawing medium (not shown in the drawings) to be placed on the pen test writing unit 61 can be replaced.

An operation unit 25 (see FIG. 5) is set on the upper surface (top plate) of the case main body 2.

The operation unit 25 is an input unit for performing various input by a user.

The operation unit 25 is provided with a power switch button to turn on the nail print apparatus 1, a stop switch button to stop an operation, a design selection button to select a design image to be drawn on a nail T, a drawing start button to instruct start of drawing and operation buttons (not shown in the drawings) for performing various types of input, for example.

A display unit 26 is set at a nearly central portion of the upper surface (top plate) of the case main body 2.

The display unit 26 is configured by including a liquid crystal display (LCD: Liquid Crystal Display), an organic electroluminescent display and other flat display, for example.

In the embodiment, on the display unit 26, a nail image (finger image including an image of a nail T) obtained by photographing a printing finger U1, an image such as the outline of the nail T included in the nail image, a design selection screen for selecting a design image to be drawn on the nail T, thumbnail images for design confirmation, instruction screens for displaying various instructions are appropriately displayed, for example.

A touch panel for performing various types of input may be integrally formed on the surface of the display unit 26.

The apparatus main body 10 is formed in a nearly box shape and includes a lower machine casing 11 which is set at the lower section in the case main body 2 and an upper machine casing 12 which is set above the lower machine casing 11 and at the upper section in the case main body 2.

First, the lower machine casing 11 will be described.

The lower machine casing 11 includes a back surface board 111, a bottom board 112, a horizontal pair of side boards 113*a* and 113*b*, an X-direction movement stage containing unit 114, a Y-direction movement stage containing unit 115 and a dividing wall 116.

The lower ends of the side boards 113*a* and 113*b* are connected to the left and right end portions of the bottom board 112, respectively, and the side boards 113*a* and 113*b* are vertically provided with respect to the bottom board 112.

As shown in FIG. 2A, the lower portion of the back surface board 111 is formed to be concave in two steps toward the front side (front side in the finger inserting direction). The lower end portion of the back surface board 111 is connected to the front end portion of the bottom board 112, and the back surface board 111 divides an area, which is surrounded by the bottom board 112 and the side boards 113*a* and 113*b*, back and forth.

The X-direction movement stage containing unit 114 and the Y-direction movement stage containing unit 115 are formed back from the concave back surface board 111 (see FIG. 2A).

In the X-direction movement stage containing unit 114, an X-direction movement stage 45 of the drawing unit 40 is contained when the drawing unit 40 is moved forward (toward the front side of the finger inserting direction).

A Y-direction movement stage 47 of the drawing unit 40 is disposed in the Y-direction movement stage containing unit 115.

The dividing wall 116 is provided inside the lower machine casing 11 so as to vertically divide a space at the front side inside the lower machine casing 11 (space at the front side of the finger inserting direction which is surrounded by the back surface board 111, bottom board 112 and the side boards 113*a* and 113*b*).

The dividing wall 116 is provided to be nearly horizontal. The lateral end portions of the dividing wall 116 are connected to the side boards 113*a* and 113*b*, respectively, and the rear end portion of the dividing wall 116 is connected to the back surface board 111.

A finger fixing unit 30 is integrally provided in the lower machine casing 11.

The finger fixing unit 30 is configured by including a finger receiving unit 31 which receives a finger (hereinafter, called "printing finger U1") corresponding to a nail T to perform drawing and a finger resting unit 32 in which fingers (hereinafter, called "non-printing fingers U2") other than the printing finger U1 rests.

The finger receiving unit 31 is disposed at a nearly central portion in the width direction of the lower machine casing 11 on the upper side of the dividing wall 116.

The space divided by the dividing wall 116 to be lower side of the lower machine casing 11 forms the finger resting unit 32.

For example, in a case where drawing is to be performed on a nail T of a ring finger, the ring finger as the printing finger U1 is inserted into the finger receiving unit 31 and the other four fingers (thumb, index finger, middle finger and little finger) which are non-printing fingers U2 are inserted into the finger resting unit 32 (see FIG. 2B).

The finger receiving unit 31 is open at the front surface side (front side in the printing finger insertion direction) of the lower machine casing 11, and defined by a finger placement unit 116*a* forming a part of the dividing wall 116 at the lower side, by dividers 31*a* and 31*b* at both lateral sides and by a divider 31*c* at the back side.

The finger placement unit 116*a* is for placing the finger (printing finger U1) of the nail T to perform drawing on the X-Y plane.

The upper side of the finger receiving unit 31 is defined by a roof 31*d*.

A window 31*e* for exposing the nail T of the printing finger U1 inserted into the finger receiving unit 31 is formed in the roof 31*d*.

A front wall 31*f* (see FIG. 1) which covers the front surface side of the lower machine casing 11 is vertically provided at each of the lateral portions of the front surface side of the lower machine casing 11 on the upper surface of the dividing wall 116.

On the upper surface of the dividing wall 116, a pair of guide walls 31*g* is vertically provided, the guide walls 31*g* being narrowing toward the finger receiving unit 31 from the end portions of the front walls 31*f* which are near the central portion and guiding the printing finger U1 into the finger receiving unit 31.

The user can sandwich the dividing wall 116 between the printing finger U1 inserted into the finger receiving unit 31 and the non-printing fingers U2 inserted into the finger resting unit 32. Thus, the printing finger U1 inserted into the finger receiving unit 31 is fixed stably.

In the embodiment, a protrusion 116*b* protruding downward is formed at the front end portion of the dividing wall 116.

The protrusion 116*b* is a tapered portion which gradually becomes thinner toward the front side and gradually becomes thicker toward the back side as shown in FIG. 2B, for example. Alternatively, the entire protrusion 116*b* is thick with respect to the concave at the back side of the dividing wall 116.

As shown in FIGS. 1 and 2A, next to the finger receiving unit 31 (the position corresponding to the medium inserting port 24 of the case main body 2, and the left side in FIG. 1 in the embodiment) on the upper surface of the dividing wall 116, the pen test writing unit 61 for after-mentioned test writing of a pen 41 is provided within a range enabling drawing by an after-mentioned drawing head 42.

It is preferable that the pen test writing unit 61 is provided so as to be nearly as high as the nail T when the printing finger U1 is inserted into the finger receiving unit 31.

The pen test writing unit 61 has a configuration in which a flat plate-like drawing medium inserted through the medium inserting port 24 of the above-mentioned case main body 2 is placed.

The drawing medium to be placed on the pen test writing unit 61 may be anything as long as it allows conditioning of a drawing portion 412*t* at the tip of the pen tip 412. The drawing medium is a sheet of paper, for example, and replaceable through the medium inserting port 24.

On the drawing medium of the pen test writing unit 61, test writing that is drawing a predetermined image such as "○" and "∞" is performed by the pen 41 before starting the drawing on the nail T. This improves the condition of the drawing portion 412*t* at the tip of pen tip 412 and suppresses the blur and break of the start of the drawing when performing the drawing on the nail T due to a dry drawing portion 412*t*, poor ink application and such like.

In the embodiment, pen caps 62 made of rubber are set in front (front side of the finger inserting direction) of the pen test writing unit 61.

The number of the provided pen caps 62 (four in the embodiment) corresponds to the plurality of pens 41 set in the drawing unit 40. After setting the pens 41 in the drawing unit 40 and when drawing is not performed (non-drawing time), the pens 41 are contained in the pen caps 62. The area where the pen caps 62 and such like are disposed is the home space where the pens 41 standby at the non-drawing time.

That is, at the non-drawing time, the pens 41 are moved directly above the pen caps 62, and thereafter the pens 41 are lowered by after-mentioned solenoids 440 (see FIG. 3A, for example), and the pen tips 412 are contained in the respective pen caps 52.

In the embodiment, as described later, a pen tip axis SL of each of the pen tips 412 of pens 41 is tilted to either one of the left and right sides in the width direction of the nail T with respect to a pen shaft axis CL of the shaft of the pen 41. Thus, each of the pen caps 62 is also formed in the shape along a tilt shape of the pen tip 412 of pen 41.

When the pens 41 are moved to the home space providing the pen caps 62, all the pens 41 are aligned in the direction that the pens 41 can be contained in the pen caps 62.

By containing the pen tips 412 in the pen caps 62 in such way, the drawing portions 412*t* of the pen tips 412 can be prevented from drying during the non-drawing time.

The shapes and such like of the pen caps 62 are not limited to the illustrated example. For example, the pen caps 62 may be a long groove-like pen cap which can receive all the pen tips 412 of a plurality of the pens 41 set in the drawing unit 40.

In the embodiment, since the pen caps 62 are provided near the pen test writing unit 61 in such way, drawing can be started by elevating a pen 41 to perform test writing in the pen test writing unit 61 which is close to the pen caps 62. Thus, it is possible to minimize the time required for moving the pen 41 and such like and perform the drawing operation rapidly.

The drawing unit 40 is configured by including the drawing head 42 which includes pens 41 that are drawing tools, a unit supporting member 44 which supports the drawing head 42, the X-direction movement stage 45 for moving the drawing head 42 in the X direction (X direction in FIG. 1, horizontal direction of the nail print apparatus 1), an X-direction movement motor 46, the Y-direction movement stage 47 for moving the drawing head 42 in the Y direction (Y direction in FIG. 2A, front-back direction of the nail print apparatus 1), a Y-direction movement motor 48 and such like.

In the embodiment, the drawing head 42 includes four pen carriages 43 each of which holds a single pen (drawing tool) 41.

The pen 41 is a writing tool which performs drawing on the surface of nail T as a drawing target surface by contacting the surface of the nail T that is the drawing target surface with the drawing portion 412*t* (see FIGS. 3A, 3B, 3C and 3F) at the tip of the pen tip 412 that is the tip portion of the pen 41.

FIGS. 3A to 3E are enlarged views of a pen carriage 43 and a pen 41 supported thereby, showing a state (drawing state) in which the drawing is being performed on the nail T.

FIG. 3A is a lateral view of the pen carriage 43 and the pen 41.

FIGS. 3B and 3C are front views of the pen carriage 43 and the pen 41 in FIG. 3A seen from the arrow b direction.

FIG. 3C shows a state in which the pen 41 shown in FIG. 3B is rotated 180 degrees around the pen shaft axis CL that is through the center of the pen shaft 411 of pen 41.

FIG. 3D is a bottom view of the pen 41 and the pen holder 431 in FIG. 3B seen from the arrow d direction;

FIG. 3E is a bottom view of the pen 41 and the pen holder 431 in FIG. 3C seen from the arrow e direction;

FIG. 3F is a view showing a state in which the drawing portion 412*t* at the tip of the pen tip 412 of the pen 41 contacts a nail T when drawing is performed on the nail T.

As shown in FIGS. 3A to 3C, each of the pens 41 held by the pen carriages 43 has a cylindrical pen shaft 411, a pen tip 412 is provided at one end of the pen shaft 411, and a drawing portion 412*t* to contact the drawing target surface is provided at the tip of the pen tip 412.

The inside of the pen shaft 411 is an ink containing unit which contains various types of ink.

The pen tip 412 has a tapered shape with a pen tip axis SL as the central axis that the tip side along the pen tip axis SL is thin and the diameter is becoming gradually larger toward the pen shaft 411 side from the tip side. The lateral surface of the pen tip 412 is an slant surface slanted with respect to the pen tip axis SL and has the drawing portion 412*t* at the tip of the pen tip 412.

The ink to be contained inside the pen shaft 411 is not especially limited in viscosity and particle diameter (size of particle) of a color material (pigment) and such like. As the ink, ink including gold and silver lame, ink including various color materials such as white pigment, ultraviolet curable ink, and ink for gel nail, undercoat, topcoat and manicure can also be widely used, for example.

Locking convex portions 411*a* (see FIGS. 4A and 4B) having shapes protruding so as to be locked into after-mentioned notches 431*a* (see FIGS. 4A and 4B) of the pen holder 431 are formed on the outer circumference of the pen shaft 411.

The shapes and such like of the locking convex portions 411*a* are not especially limited as long as they can be locked into the notches 431*a*.

The pen 41 is positioned at a position that an after-mentioned pen tip axis SL of the pen tip 412 is tilted from the vertical direction to one side (for example, right side) or to the other side (for example, left side) in the width direction of the nail T in a state in which a locking convex portion 411*a* is locked into a notch 431*a*.

In the embodiment, as described later, a pair of notches 431*a* are formed at positions facing each other in the pen holder 431. The locking convex portions 411*a* are provided at the two positions corresponding to the pair of notches 431*a*, for example.

The pen 41 can be positioned as long as the locking convex portion 411*a* is locked into either one of the notches 431*a*. Thus, the locking convex portion 411*a* may be provided only at a single position.

The pen 41 is, for example, a pen having a drawing portion 412*t* of a ballpoint pen type which performs drawing by the drawing portion 412*t* at the tip of the pen tip 412 being pressed against the surface of the nail T and the ink contained in the pen shaft 411 being applied to the surface of the nail T.

The pen 41 is not limited to the ballpoint pen type. The pen 41 may also be a felt pen type which performs drawing with ink sinking through the felt-like member forming the drawing portion 412*t* or a calligraphy pen type which performs drawing with ink sinking through a tied brush forming the drawing portion 412*t*, for example. Drawing portions 412*t* with various types of thickness and shapes can also be prepared.

The plurality of pens 41 to be held by the pen carriages 43 may have the drawing portions 412*t* of a same type or may have different types of drawing portions 412*t*.

As shown in FIGS. 3B to 3E, the pen 41 which is a drawing tool has a shape that the pen tip axis SL through the drawing portion 412*t* at the tip of the pen tip 412 and the center of the pen tip 412 is tilted at a predetermined angle 8 with respect to the pen shaft axis CL through the center of the pen shaft 411.

Here, the pen 41 is inserted to the pen holder 431 of the pan carriage 43 to be held so that the pen shaft axis CL is in the vertical direction (in the embodiment, the direction orthogonal to the surface of the finger placement unit 116*a* to place the nail T).

The pen 41 is set in an tilt direction (tilt direction shown in FIG. 3C, hereinafter, called first tilt direction) that the pen tip axis SL of the pen tip 412 is tilted at the angle θ from the vertical direction to one side (right side) in the width direction of the nail T placed on the finger placement unit 116*a* or in an tilt direction (tilt direction shown in FIG. 3B, hereinafter, called second tilt direction) that the pen tip axis SL of the pen tip 412 is tilted at the angle θ from the vertical direction to the other side (left side).

The pen 41 is loaded into the pen carriage 43 so that the pen tip axis SL is tilted in the first tilt direction or the second tilt direction as the initial state.

In a case where the pen tip axis SL of the pen 41 is tilted in the first tilt direction, by the pen 41 being rotated 180 degrees around the pen shaft axis CL as the center, the tilt direction of the pen tip axis SL of the pen 41 is set to be the second tilt direction. On the other hand, in a case where the pen tip axis SL of the pen 41 is tilted in the second tilt direction, by the pen 41 being rotated 180 degrees around the pen shaft axis CL as the center, the tilt direction of the pen tip axis SL of the pen 41 is set to be the first tilt direction.

The tilt direction of the pen tip axis SL of the pen tip 412 is set according to the curved shape of the nail T to perform drawing. That is, as shown in FIG. 3F, when the drawing is performed around the right end portion of the nail T, the tilt direction of the pen tip axis SL of the pen tip 412 is set to be the second tilt direction tilted to the left side. On the other hand, when the drawing is performed around the left end portion of the nail T, the tilt direction of the pen tip axis SL of the pen tip 412 is set to be the first tilt direction tilted to the right side.

By controlling the tilted direction of the pen tip axis SL of the pen tip 412 in such way, the drawing portion 412*t* of the pen tip 412 can easily contact even the end portions of the curved nail T and it is possible to suppress the blur and break of the line drawn on the end portions of nail T.

The L shown in FIGS. 3B and 3C indicates the length of the pen tip 412, and D indicates a shift amount of the drawing portion 412*t* at the tip of the pen tip 412 with respect to the case where the pen tip axis SL is not tilted. That is, the shift amount D is the distance between a base point P and the drawing portion 412*t*, the base point P being the intersection between the pen shaft axis CL and the horizontal plane as a reference (that is, the surface of the finger placement unit 116*a* on which the nail T is placed, for example). Here, for example, when the L is 5 mm and the tilt angle θ of the pen tip axis SL with respect to the pen shaft axis CL (vertical line) is 20 degrees, the shift amount D is 1.82 mm.

Figure 4A:
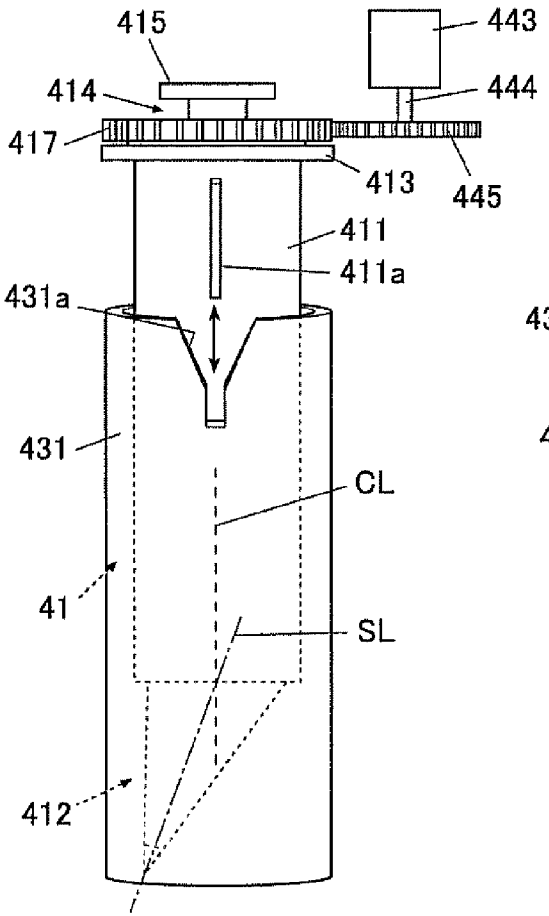
FIG. 4A is an enlarged view of a pen and a pen holder showing a state in which a pen tip axis of the pen tip is tilted to the left.
Figure 4B:
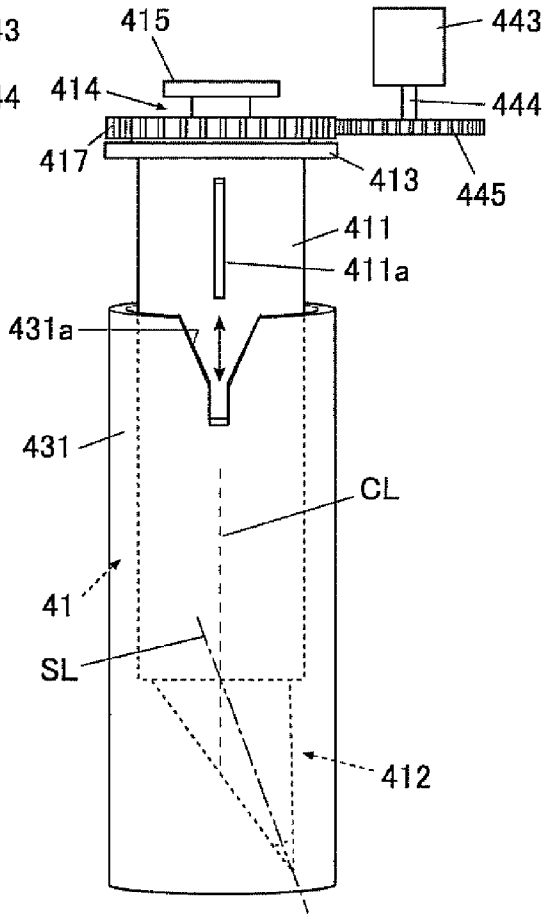
FIG. 4B is an enlarged view of a pen and a pen holder showing a state in which a pen tip axis of the pen tip is tilted to the right.

FIGS. 4A and 4B are views showing a state in the embodiment in which the pen 41 is lifted up in the pen holder 431 so as to be rotatable in the pen holder 431, seen from the front side (right side in FIG. 2A) of the nail print apparatus 1.

FIG. 4B shows a state in which the pen 41 in the state of FIG. 4A is rotated 180 degrees around the pen shaft axis CL as the center.

When the pen 41 is lowered from the state shown in FIGS. 4A and 4B, the locking convex portion 411*a* is locked into the notch 431*a*.

The direction of the pen tip 412 is stored in an after-mentioned pen tip direction storage area 824 of a storage unit 82.

At the other end side of the pen shaft 411 (that is, the opposite side to the pen tip 412), a cover 414 including a flange 413 which extends outside the pen shaft 411 is attached.

Materials forming the pen shaft 411 and the cover 414 are not especially limited. However, the preferable material forming the pen shaft 411 and the cover 414 is resin and such like suitable for mass production of the pen 41.

In the embodiment, a finger grip 415 is provided at the upper portion of the cover 414 so as to be easily pinched by a hand, a pair of tweezers and such like. A small iron piece 416 is further provided to the finger grip 415 by embedding, attachment and such like so as to be absorbed to a magnet.

Each of the pens 41 is held by being merely inserted into a pen holding unit 437*d* and a pen holder 431 of a pen carriage 43 from above as described later. Thus, the pen 41 can be replaced easily by a method such as pinching the finger grip 415 with a hand or a pair of tweezers or by approaching a stick' member (not shown in the drawings) which has a magnet attached at the tip thereof toward the finger grip 415 to absorb and raise the iron piece 416 to the magnet after opening the pen replacement cover 23 provided at the case main body 2, for example.

Thus, the user can appropriately replace, by a simple procedure, each of the pens 41 set in the pen carriages 43 with pens 41 having different types of pen tips 412 or different types of ink according to the nail design to be drawn, and can achieve a desired nail design.

In the embodiment, as shown in FIGS. 3A, 3B and 3C, a rotation gear 417 is provided at the upper section (between the flange 413 and the finger grip 415 in the embodiment) of the pen 41.

The rotation gear 417 is formed to have an outer diameter which is the same as or larger than that of the portion (flange 413 in the embodiment) having the largest outer diameter in the pen 41.

As shown in FIGS. 4A and 4B, a pen rotation motor 443 for rotating the rotation gear 417 is provided around the pen 41.

The pen rotation motor 443 is for rotating the pen 41 around the pen shaft axis CL as the center of the pen shaft 411 of the pen 41 (around the axis of the pen 41 or the pen holder 431 holding the pen 41). The pen rotation motor 443 forms a part of the drawing tool driving unit which reverses the tilt direction of the pen tip axis SL of the pen tip 412 which is the tip portion of the pen 41 by rotating the pen 41 180 degrees around the axis.

That is in a state in which the tilt direction of the pen tip axis SL of the pen 41 is the first tilt direction (pen tip axis SL of the pen tip 412 which is the tip portion of the pen 41 is tilted to the right with respect to the vertical direction, see FIG. 4B), when the pen rotation motor 443 is operated to rotate the pen 41 by 180 degrees around the axis of the pen 41, the direction of the pen tip 412 is reversed and the tilt direction of the pen tip axis SL becomes the second tilt direction (see FIG. 4A) that the pen tip axis SL is tilted to the left with respect to the vertical direction.

Figure 5:
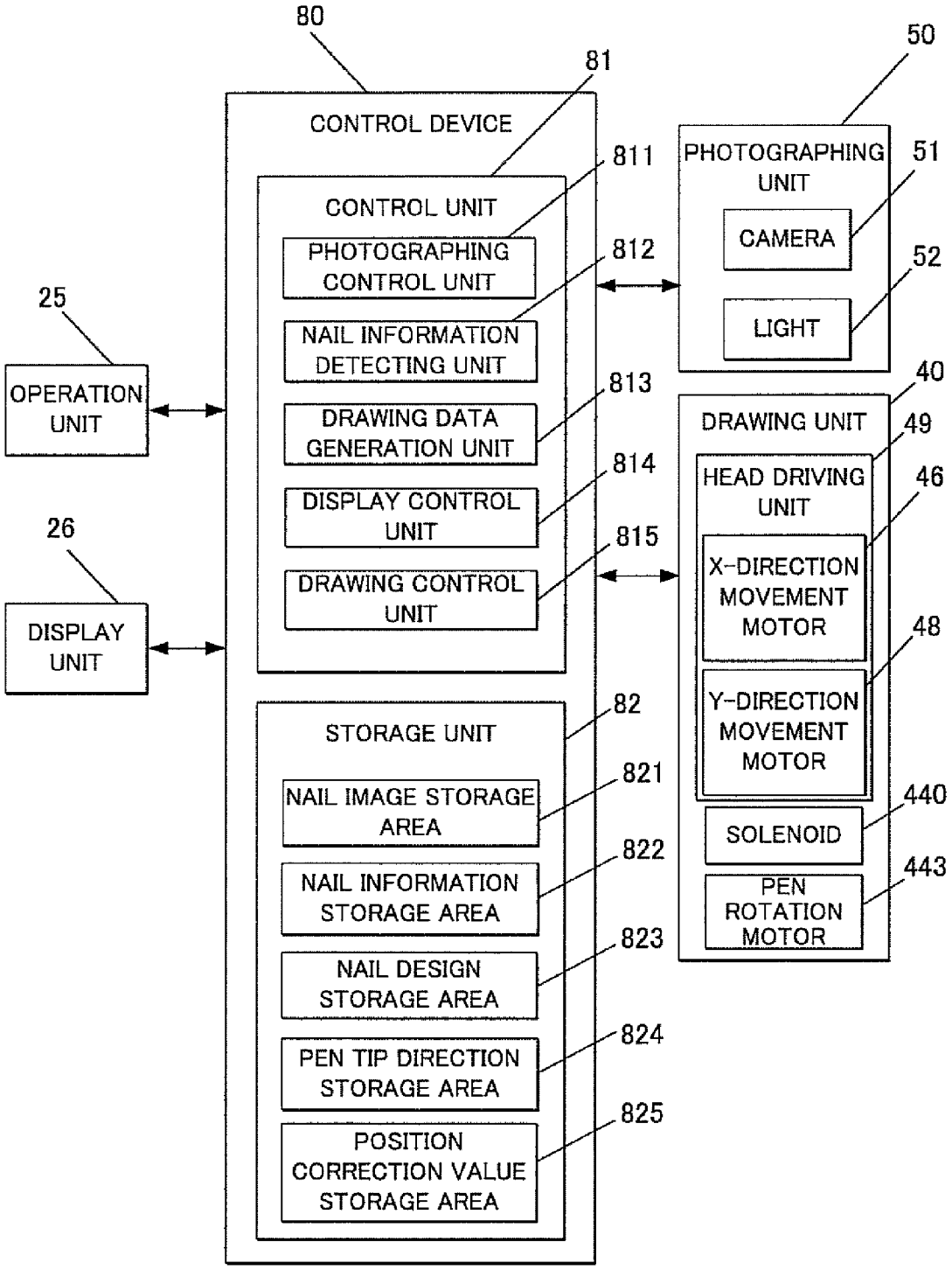
FIG. 5 is a main part block diagram showing a control structure of a nail print apparatus according to the first embodiment.

The pen rotation motor 443 is controlled by an after-mentioned drawing control unit 815 (see FIG. 5).

As the pen rotation motor 443, for example, various motors such as a stepping motor which can control the rotation amount by the drawing control unit 815 can be applied.

The pen rotation motor 443 is provided with a motor gear 445 to engage with the rotation gear 417 via a shaft 444.

Figure 4C:
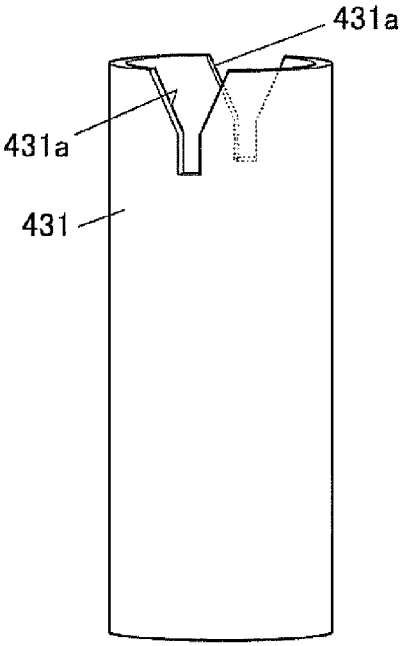
FIG. 4C is an enlarged view of a pen and a pen holder and is a perspective view of the pen holder.
Figure 4D:
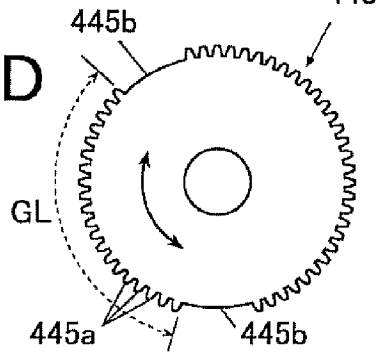
FIG. 4D is an enlarged view of a pen and a pen holder and is a top view of a motor gear.

FIG. 4D is a plan view of the motor gear 445 in the embodiment.

As shown in FIG. 4D, gear portions 445*a* to engage with the rotation gear 417 and detachment portions 445*b* which have no gear are formed at the outer circumference of the motor gear 445 in the embodiment.

The length GL of the gear portions 445*a* is nearly a half of the length of the outer circumference of the rotation gear 417, and the detachment portions 445*b* are respectively arranged at both sides of the gear portions 445*a*.

Thus, in a case where the motor gear 445 is rotated while engaging with the rotation gear 417, when the pen 41 is rotated approximately 180 degrees around its axis, a detachment portion 445*b* having no gear is located at the position facing the rotation gear 417. In this state, the engagement between the rotation gear 417 and the motor gear 445 is released and the rotation of pen 41 is stopped.

In the state in which the detachment portion 445*b* is located at the position facing the rotation gear 417, the rotation gear 417 is not engaged with the motor gear 445. Thus, the pen 41 can be moved up and down. Thus, the attachment/detachment of the pen 41 can be performed smoothly when replacing the pen 41 and such like.

In the embodiment, in the state in which the detachment portion 445*b* is located at the position facing the rotation gear 417, the above-mentioned locking convex portions 411*a* are located at after-mentioned positions corresponding to the notches 431*a* of the pen holder 431 (see FIGS. 4A and 4B).

That is, when the engagement between the rotation gear 417 and the motor gear 445 is released at the position facing the detachment portion 445*b*, the pen 41 can move downward, and when the pen 41 moves downward, the locking convex portion 411*a* is locked into the notch 431*a*.

Each of the pen carriages 43 is provided with the pen holder 431 which holds the pen 41 with the pen shaft axis nearly vertical and a pen lifting mechanism 432 for moving the pen 41 up and down.

The pen holder 431 is open at top and bottom sides and has a tubular shape to hold the pen 41. The pen tip 412 and the pen shaft 411 are inserted through the pen holder 431.

FIG. 4C is a schematic view showing an example of the pen holder 431 in the embodiment.

As shown in FIG. 4C, a pair of notches 431*a* to which the locking convex portions 411*a* provided on the pen shaft 411 are locked is formed at the upper open part of the pen holder (drawing tool holder).

Each of the notches 431*a* is tapered that the width is largest at the end portion near the open part and is gradually smaller downward. The lower end portion of the notch 431*a* is a slit-like portion which has a width slightly larger than the width of the locking convex portion 411*a*.

By the notch 431*a* being in the tapered shape in such way, even when the pen 41 falls down through the pen holder 431 from a position shifted from the center of the width within the range of the width of the Wend portion near the open part of the notch 431*a*, the locking convex portion 411*a* is guided along the slant surface in the tapered shape and engaged with the slit-like portion of the lower end portion of the notch 431*a*, and the pen 41 is positioned at the appropriate position. Thus, the rotation angle of the pen 41 by the motor gear 445 may not be the exact 180 degrees as long as it is within the range of angle that the pen 41 is within the width of the tapered end portion near the open part of the notch 431*a*.

Thus, in the state in which the locking convex portion 411*a* is engaged with the slit-like portion at the lower end of the notch 431*a*, the pen 41 is positioned in the first tilt direction that the tilt direction of the pen tip axis SL of pen tip 412 is tilted to the right with respect to the vertical direction or the second tilt direction that the pen tip axis SL of the pen tip 412 is tilted to the left with respect to the vertical direction.

As shown in FIG. 3A, the pen lifting mechanism 432 includes a solenoid 440 configured by including a plunger 434 and a coil unit 435, a pin 436 which is attached to the moving end side of the plunger 434 of the solenoid 440, a pen lifting lever 437 which is joined to the plunger 434 via the pin 436 and a stopper 438 which suppresses too much elevation of the pen lifting lever 437.

The solenoid 440 has a mechanism in which the movable plunger 434 performs reciprocating motion like a piston in the coil unit 435 wound by copper wire or the like.

The plunger 434 is forced forward (right direction in FIGS. 2A and 3A) by the spring 433, and the solenoid 440 is a pull type solenoid which absorbs the plunger 434 backward (left direction in FIGS. 2A and 3A) against the elastic force of the spring 433.

The solenoid 440 is not limited to the pull type and may be configured to be a push type.

As shown in FIG. 3A, the pen lifting lever 437 is an L-shaped member in which a shorter arm 437*a* is nearly perpendicular to a longer arm 437*b*. A long hole 437*c* to be locked to the pin 436 is formed at the end portion of the shorter arm 437*a*.

The pen holding unit 437*d* to insert the pen 41 is provided at the end portion of the longer arm 437*b*.

The pen holding unit 437*d* is formed in a ring shape having an inner diameter which is larger than the diameters of the pen shaft 411 and the pen tip 412 of the pen 41 and smaller than the diameter of flange 413 of the pen 41. The pen shaft 411 and the pen tip 412 are inserted through the pen holding unit 437*d*, which locks the flange 413 so as to support it from below.

A supporting shaft 439 is inserted through the intersection of the shorter arm 437*a* and the longer arm 437*b* in the pen lifting lever 437 from the pen carriage 43 side.

In the embodiment, when the solenoid 440 is being driven, as shown in FIG. 3A, the plunger 434 is pulled back against the elastic force of the spring 433, and the pen lifting lever 437 locked to the pin 436 of the plunger 434 is held at a position where the longer arm 437*b* is nearly horizontal.

In this state, the pen tip 412 of the pen 41 is lowered to be lower than the pen holder 431 of the pen carriage 43 and the drawing portion 412*t* at the tip of the pen tip 412 can contact the surface of the nail T and the drawing medium, which is a drawing state.

On the other hand, in a state in which the solenoid 440 is released, the plunger 434 protrudes forward by the elastic force of the spring 433. At this time, the pen lifting lever 437 locked to the pin 436 of the plunger 434 is rotated upward (counterclockwise direction) around the rotation shaft 439 as a supporting point, and the longer arm 437*b* contacts the stopper 438 to be stopped.

Thus, the flange portion 413 of the pen 41 is flipped up by the pen lifting lever 437 (see FIG. 2A).

In this state, the pen tip 412 of the pen 41 is lifted up in the pen holder 431 of the pen carriage 43 and the drawing portion 412*t* at the tip of the pen tip 412 does not contact the surface of the nail T and the drawing medium, which is a non-drawing state.

In such way, the force moving the plunger 434 forward and backward by the solenoid 440 is converted into a force moving the pen 41 upward and downward by the rotation shaft 439 and the pen lifting lever 437 which is rotated around the rotation shaft 439 as the supporting point.

The pen 41 is inserted into the pen holder 431 of the pen carriage 43 to be held and not fixed to the pen lifting lever 437 and such like. Thus, the pen 41 is forced downward by its own weight.

Thus, the pen 41 can move down freely along the pen holder 431 to the position where the flange 413 contacts the upper surface of the pen holding unit 437*d*. When the drawing portion 412*t* of the pen tip 412 contacts the nail T surface or the drawing medium in the drawing state, the drawing portion 412*t* of the pen tip 412 is pressed against the nail T surface or the drawing medium by its own weight, and freely moves in the Z direction (that is, upward and downward) orthogonal to the X-Y plane on which the printing finger U1 is placed in accordance with the surface shape (unevenness of the surface and such like) of the nail T.

The pen 41 is extremely light that the weight thereof is several grams to several tens of grams. Thus, the user does not feel pain when the drawing portion 412*t* of the pen tip 412 contacts the nail T. Furthermore, since the writing pressure of the pen 41 is secured by its own weight, the user can draw a nail design on the nail T successfully.

In the embodiment, among the members forming the pen lifting mechanism 432, the supporting shaft 439 and the stopper 438 are formed of metal such as stainless steel, and the other members are formed of materials such as resin which are light and do not react to a magnet.

The materials of the members forming the pen lifting mechanism 432 are not limited to the examples illustrated here.

In the embodiment, the solenoid 440 is used as an actuator for moving the pen 41 up and down. However, the actuator for moving the pen 41 up and down is not limited to the solenoid 440. Since the pen 41 is light, the actuator for moving the pen 41 up and down can be formed by various types of compact driving devices as well as the solenoid.

The unit supporting member 44 which supports the drawing head 42 is fixed to the X-direction movement unit 451 which is attached to the X-direction movement stage 45.

The X-direction movement unit 451 is moved in the X-direction along the guide which is not shown in the drawings on the X-direction movement stage 45 by the drive of the X-direction movement motor 46. Thus, the drawing head 42 is moved in the X-direction (X-direction in FIG. 1, horizontal direction of the nail print apparatus 1).

The X-direction movement stage 45 is fixed to the Y-direction movement unit 471 of the Y-direction movement stage 47.

The Y-direction movement unit 471 is moved in the Y-direction along the guide which is not shown in the drawings on the Y-'direction movement stage 47 by the drive of the Y-direction movement motor 48. Thus, the drawing head 42 is moved in the Y-direction (Y-direction in FIG. 2A, front-back direction of the nail print apparatus 1).

In the embodiment, the X-direction movement stage 45 and the Y-direction movement stage 47 are formed by combining the X-direction movement motor 46, the Y-direction movement motor 48, and ball screws and guides which are not shown in the drawings, for example.

As the X-direction movement motor 46 and the Y-direction movement motor 48 in the embodiment, a stepping motor, which moves for a predetermined amount every time a single pulse is transmitted, is applied.

In the embodiment, a head driving unit 49 (see FIG. 5) which drives the drawing head 42 including the pens 41 that perform drawing on the nail T in the X-direction and the Y-direction is formed by the X-direction movement motor 46, the Y-direction movement motor 48 and such like.

The solenoids 440 for moving pens 41 up and down, the pen rotation motor 443, the X-direction movement motor 46 and the Y-direction movement motor 48 in the drawing unit 40 are connected to an after-mentioned drawing control unit 815 (see FIG. 5) of the control device 80 and controlled by the drawing control unit 815.

As shown in FIGS. 1 and 2A, a photographing unit 50 is provided on the upper machine casing 12.

That is, a substrate 13 is set on the upper machine casing 12, and two cameras 51 as a photographing device are set at the central portion of the lower surface of the substrate 13.

It is preferable that each of the cameras 51 is a compact camera which is configured by including a solid-state image sensing device having approximately two million pixels or more and a lens, for example.

Each of the cameras 51 photographs the nail T of the printing finger U1 inserted into the finger inserting unit 31 and obtains a nail image (finger image including an image of nail T) which is an image of nail T of the printing finger U1.

In the embodiment, the two cameras 51 are provided so as to be nearly parallel to each other in the width direction of the nail T of the printing finger U1 inserted into the printing finger receiving unit 31.

Among the two cameras 51, one camera 51 is provided so as to face to the bottom surface of the finger receiving unit 31 and photograph the nail T from directly above.

The other camera 51 is provided so as to be slightly tilted with respect to the bottom surface of the finger receiving unit 31 and photograph the nail T from obliquely above.

On the substrate 13, lights (lighting device) 52 such as white LEDs are set so as to surround the cameras 51. The lights 52 illuminate the nail T of the printing finger U1 at photographing by the cameras 51. The photographing unit 50 is configured by including the cameras 51 and the lights 52.

The photographing unit 50 is connected to an after-mentioned photographing control unit 811 (see FIG. 5) in the control device 80 and controlled by the photographing control unit 811.

Image data of the image obtained by the photographing unit 50 is stored in a nail image storage area 821 of an after-mentioned storage unit 82.

In the embodiment, the nail T can be photographed from at least two different positions or angles by the two cameras 51 as the photographing device, and at least two nail images are obtained.

Then, on the basis of the nail images, an after-mentioned nail information detecting unit 812 can detect nail information such as the slant angle (hereinafter, called "slant angle of nail T" or "nail curvature") of the nail T surface with respect to the X-Y plane and a vertical position of nail T in addition to the outline (shape of nail T) of nail T.

The control device 80 is set on the substrate 13 or such like disposed on the upper machine casing 12, for example.

FIG. 5 is a main part block diagram showing a control structure in the embodiment.

As shown in FIG. 5, the control device 80 is a computer which includes a control unit 81 having a CPU (Central Processing Unit) and the storage unit 82 having a ROM (Read only memory), a RAM (Random access memory) and such like which are not shown in the drawings.

Various programs for operating the nail print apparatus 1 and various types of data are stored in the storage unit 82.

Specifically, in the ROM of the storage unit 82, various programs such as a nail information detecting program for detecting nail information such as the shape of the nail T from the nail image, a drawing data generation program for generating drawing data and a drawing program for performing drawing processing are stored. The control device 80 executes the programs to integrally control the units of the nail print apparatus 1.

The storage unit 82 is provided with a nail image storage area 821 for storing a nail image of the nail T of the printing finger U1 of the user obtained by the photographing unit 50, a nail information storage area 822 for storing the nail information detected by the nail information detecting unit 812 and a nail design storage area 823 for storing image data of nail designs to be drawn on the nail. T.

In the embodiment, as described above, the initial state is the first tilt state that the pen tip axis SL of the pen tip 412 of the pen 41 is tilted to the right. Thus, the image data of nail design stored in the nail design storage area 823 is also formed so that drawing is correctly performed when performing the drawing with the pen tip 412 in the first tilt direction.

Further, the pen tip direction storage area 824 and the position correction value storage area 825 are provided in the storage unit 82 in the embodiment.

The pen tip direction storage area 824 is for storing the direction of the pen tip 412 of the pen 41.

In the embodiment, as described above, the pen 41 can be in the first tilt direction that the pen tip axis SL of the pen tip 412 which is the tip portion of the pen 41 is tilted to the right with respect to the vertical direction and in the second tilt direction that the pen tip axis SL of the pen tip 412 which is the tip portion of the pen 41 is tilted to the left with respect to the vertical direction. The tilt direction of the pen tip axis SL of the pen tip 412 is stored in the pen tip direction storage area 824 as needed.

As described later, the drawing control unit 815 controls the operation of the pen rotation motor 443 appropriately with reference to the tilt direction of the pen tip axis SL of the pen tip 412 stored in the pen tip direction storage area 824 of the storage unit 82.

The position correction value storage area 825 is for storing a correction value for correcting the drawing position by the pen 41 corresponding to the tilt direction of the pen tip axis SL of the pen tip 412.

As described above, the shift amount of the drawing portion 412*t* of the pen tip 412 from the base point P is 1.82 mm when the length L of the pen tip 412 is 5 mm and the tilt angle θ of the pen tip axis SL with respect to the pen shaft axis CL (vertical line) is 20 degrees. Thus, the movement distance of the drawing portion 412*t* is 3.64 mm (=3640 μm) when the tilt direction of the pen tip axis SL of the pen tip 412 is changed from the first tilt direction that the pen tip axis SL is tilted to the right to the second tilt direction that the pen tip axis SL is tilted to the left. This movement distance (3640 μm) is stored as the correction value in the position correction value storage area 825.

In the embodiment, image data of nail design is prepared setting, as a reference, the first tilt direction that the pen tip axis SL of the pen tip 412 is tilted to the right. When the tilt direction of the pen tip axis SL of the pen tip 412 is changed to the second tilt direction that the pen tip axis SL is tilted to the left, the position of the drawing portion 412*t* of the pen tip 412 when performing drawing is corrected to be shifted by the correction value (3640 μm) stored in the position correction value storage area 825 in the X direction so as to be located at the same position thereof when the tilt direction of the pen tip axis SL is the first tilt direction.

In a functional view, the control unit 81 includes the photographing control unit 811, the nail information detecting unit 812, the drawing data generation unit 813, the display control unit 814, the drawing control unit 815 and such like. The functions as the photographing control unit 811, the nail information detecting unit 812, the drawing data generation unit 813, the display control unit 814, the drawing control unit 815 and such like are achieved in cooperation between the CPU of the control unit 81 and the programs stored in the ROM of the storage unit 82.

The photographing control unit 811 controls the cameras 51 and the lights 52 of the photographing unit 50 to photograph images of a finger (hereinafter, called "nail images") including the images of the nail T of the printing finger U1 inserted into the finger receiving unit 31 with the cameras 51.

In the embodiment, the photographing control unit 811 obtains at least two nail images from different positions or angles (for example, from directly above the nail T and obliquely from above the nail T) with the two cameras 51.

The image data of nail images obtained by the photographing unit 50 may be stored in the storage unit 82.

The nail information detecting unit 812 detects the nail information for the nail T of the printing finger U1 on the basis of the images of the nail T of the printing finger U1 inserted into the finger receiving unit 31 which are obtained by the cameras 51.

Here, the nail information includes the outline of the nail T (the nail shape and horizontal position of the nail T) the slant angle of the nail T surface with respect to the X-Y plane (slant angle and nail curvature of nail T), and the height of the nail T (position in the vertical direction of the nail T, hereinafter, called "vertical position of the nail T" or merely called "position of the nail T").

The slant angle (nail curvature) of the nail T is an angle with respect to the horizontal plane in the width direction of nail T surface (that is, the X-Y plane of the finger placement unit 116*a* on which the printing finger U1 is placed).

Specifically, the nail information detecting unit 812 detects the outline (shape and size) and position of the nail T from the nail images of the nail T of the printing finger U1 which are obtained by the cameras 51 and obtains the outline as information represented by x and y coordinates and such like.

The nail information detecting unit 812 detects the outline (shape) of the nail T on the basis of the difference in color and such like between the nail T and the other finger portion from the nail images of the nail T of the printing finger U1 obtained by the cameras 51, for example.

The method of detecting the outline (shape) of the nail T by the nail information detecting unit 812 is not especially limited, and not limited to the above examples.

The nail information detecting unit 812 functions as an slant angle detecting unit which detects the slant angle (nail curvature) of nail T on the basis of at least two nail images obtained by the two cameras 51.

The nail information detecting unit 812 detects the slant angle (nail curvature) for the nail T of the user from the two nail images photographed from different positions or angles (for example, from directly above and from obliquely above the nail T) with the two cameras 51, for example.

The nail information detecting unit 812 only needs to detect the outline (nail shape) of the nail T on the basis of the nail images, and does not need to obtain all of the above nail information.

The drawing data generation unit 813 generates data for the drawing to be performed on the nail T of the printing finger U1 by the drawing head 42 on the basis of the nail information detected by the nail information detecting unit 812.

Specifically, the drawing data generation unit 813 performs a fitting process by enlarging, reducing, cutting out and such like the image data of the nail design on the basis of the shape and such like of the nail T detected by the nail information detecting unit 812, and generates data for performing drawing on the nail T.

In a case where the nail information detecting unit 812 also obtains the slant angle of nail T (nail curvature) as the nail information, the drawing data generation unit 813 performs curved surface correction of the image data of nail design in accordance with the slant angle of nail T (nail curvature).

The display control unit 814 controls the display unit 26 to display various display screens on the display unit 26. In the embodiment, for example, the display control unit 814 makes the display unit 26 display various screens such as a selection screen of nail design, thumbnail images for design confirmation and a nail image obtained by photographing printing finger U1 including the nail T.

The drawing control unit 815 is a control unit which outputs drawing data generated by the drawing data generation unit 813 to the drawing unit 40 and controls the solenoids 440, the pen rotation motor 443, the X-direction movement motor 46 and the Y-direction movement motor 48 of the drawing unit 40 so as to perform drawing on the nail T according to the drawing data.

In the embodiment, the drawing control unit 815 sets the central position (position of the central line indicted by the dashed line in FIG. 3F) in the width direction of the nail T surface (horizontal direction in FIG. 3F) as a switching position CP. Then, the drawing control unit 815 changes the tilt direction of the pen tip axis SL of the pen tip 412 from the first tilt direction that the pen tip axis SL is tilted to the right to the second tilt direction that the pen tip axis SL is tilted to the left, or from the second tilt direction to the first tilt direction on the basis of the switching position CP as the boundary.

Specifically, the drawing control unit 815 always determines the drawing position to perform drawing on the drawing target surface. If the drawing position is in the right with respect to the central portion in the width direction of nail T surface (horizontal direction in FIG. 3F), the drawing control unit 815 controls the pen rotation motor 443 so as to set the tilt direction of the pen tip axis SL of the pen tip 412 to the second tilt direction that the pen tip axis SL is tilted to the left with respect to the vertical direction. If the drawing position is in the left with respect to the central portion, the drawing control unit 815 controls the pen rotation motor 443 so as to set the tilt direction of the pen tip axis SL of the pen tip 412 to the second tilt direction that the pen tip axis SL is tilted to the right with respect to the vertical direction.

Furthermore, in the embodiment, when the tilt direction of the pen tip axis SL of the pen tip 412 of the pen 41 is changed from the first tilt direction to the second tilt direction, the drawing data generation unit 813 corrects the position of the pen tip 412 by the correction value stored in the position correction value storage area 825.

When a continuous design part (for example, a picture such as a flower pattern and a star pattern) exists across the switching position CP, it is preferable to control so as not to change the tilt direction of the pen tip axis SL of the pen tip 412 until the drawing of the design part (picture) is completed. That is, if the tilt direction of the pen tip axis SL of the pen tip 412 is changed in the continuous design part, for example, the direction to apply ink is changed at the position where the tilt direction is changed, and thus, the shape of the applied line is disturbed in some cases.

Thus, it is possible to achieve a nail print with beautiful finish by making control so as not to change the tilt direction of the pen tip axis SL of the pen tip 412 during the drawing of the continuous design part (picture).

Next, operations and a drawing control method of the nail print apparatus 1 in the embodiment will be described with reference to FIG. 6 and others.

When drawing is to be performed by the nail print apparatus 1, the user first turns on the power switch to activate the control device 80.

The display control unit 814 makes the display unit 26 display the design selection screen.

The user operates an operation button or such like of the operation unit 25 to select a desired nail design among a plurality of nail designs displayed on the design selection screen. Thus, a selection instruction signal is output from the operation unit 25 to select the nail design to be drawn on the nail T.

When the nail design is selected, the control unit 81 makes the display unit 26 display an instruction screen instructing to set the pens 41 necessary to draw the selected nail design into predetermined pen carriages 43 of the drawing head 42.

For example, when red ink and gold ink including lame are necessary, the control unit 81 indicates the inks of pens 41 to be set and the pen carriages 43 to set the respective pens 41 on the display unit 26.

The user sets predetermined types of pens 41 in the predetermined pen carriages 43 according to the instruction displayed on the display screen.

The user may dare to set a pen 41 different from the instruction to achieve a nail design of preferred color or texture.

The apparatus may be configured so that the control unit 81 can read out the types of pens 41 set in the respective pen carriages 43 by a barcode or such like. In this case, nail designs which can be drawn by the pens 41 set in the pen carriages 43 may be displayed on the design selection screen of the display unit 26 to make the user select a nail design among them.

Next, the control unit 81 makes the display unit 26 display an instruction screen which instructs inserting a printing finger U1 into the finger receiving unit 31.

The user inserts the printing finger U1 into the finger receiving unit 31 according to the instruction, inserts the non-printing fingers U2 into the finger resting unit 32 to fix the printing finger U1, and then operates the drawing switch.

For example, FIG. 2B shows an example in which the ring finger of left hand as the printing finger U1 is inserted into the finger receiving unit 31, and the other fingers as the non-printing fingers U2 are inserted into the finger resting unit 32.

When the drawing start instruction is input from the drawing switch, before starting the drawing operation, the photographing control unit 811 controls the photographing unit 50 first to photograph the printing finger U1 with the cameras 51 while illuminating the printing finger U1 with the lights 52.

Thus, the photographing unit 50 obtains images of the nail T (nail images) of the printing finger U1 inserted into the finger receiving unit 31.

Figure 6:
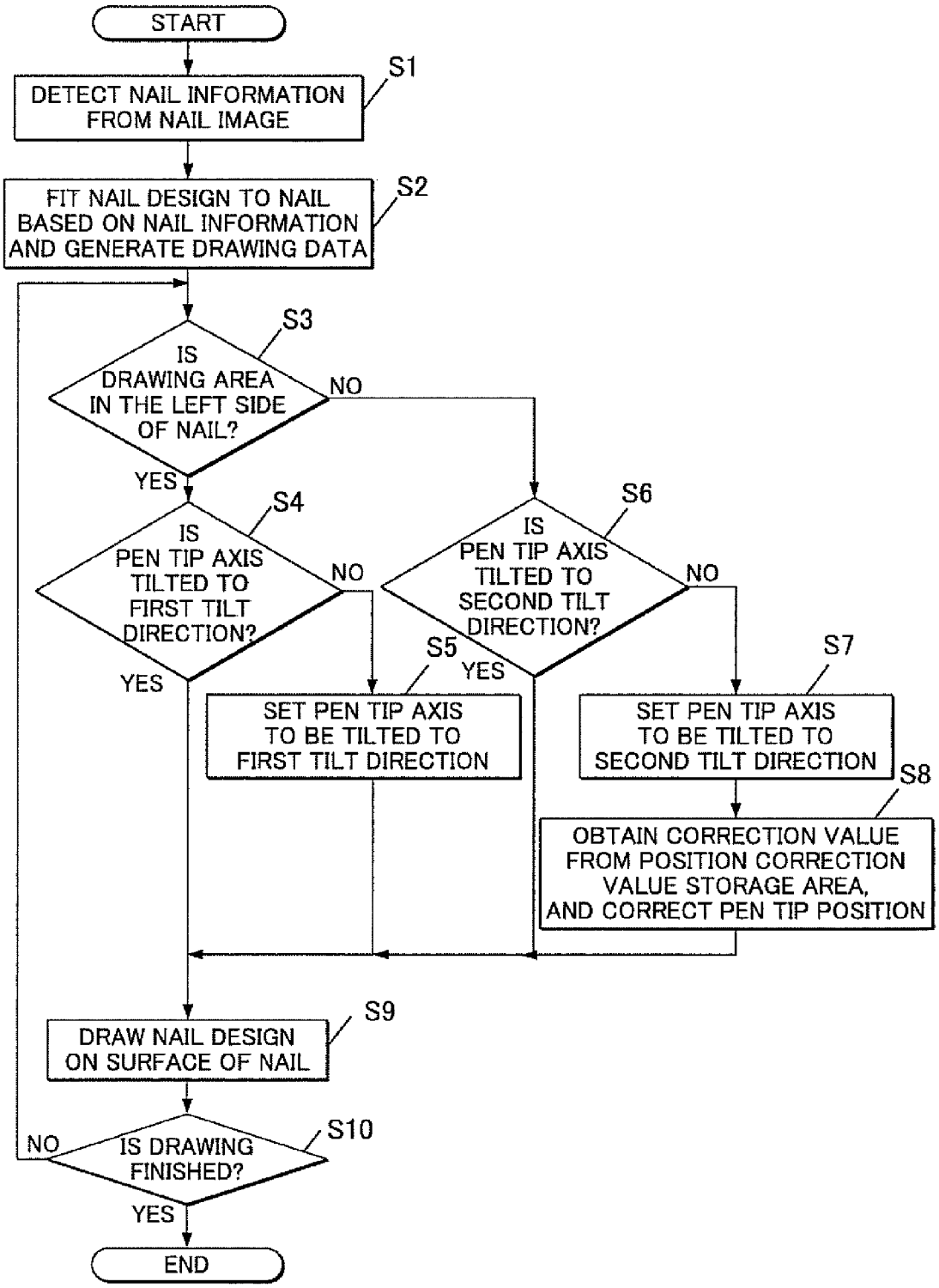
FIG. 6 is a flowchart showing drawing processing of the nail print apparatus according to the first embodiment.

Next, as shown in FIG. 6, the nail information detecting unit 812 detects nail information such as the outline (nail shape) of the nail T on the basis of the nail images (step S1).

When the nail information such as the outline (nail shape) of the nail T is detected by the nail information detecting unit 812, the drawing data generation unit 813 performs fitting of the image data of nail design into the nail T on the basis of the nail information.

The drawing data generation unit 813 appropriately performs curved surface correction for the image data of nail design on the basis of the nail information. Thus, the drawing data is generated (step S2).

Before starting drawing on the nail T, the drawing control unit 815 moves the drawing unit 40 toward the pen test writing unit 61 and drives the solenoid 440 of the pen carriage 43 holding the pen 41 to enable the pen 41 to perform drawing.

Then, test writing is performed by drawing a predetermined figure such as "○" and "∞" on the drawing medium.

The test writing may be performed only for the pens 41 necessary to draw the selected nail design or may be performed for all the pens 41.

When the drawing data is generated and test writing is also completed, the drawing control unit 815 determines whether the drawing position is in the left side with respect to the central portion in the width direction (horizontal direction in FIG. 3F) of nail T (step S3).

If the drawing position is determined to be in the left side in the width direction of the nail T (step S3; YES), next, the drawing control unit 815 determines whether the tilt direction is the first tilt direction that the pen tip axis SL of the pen tip 412 is tilted to the right with respect to the vertical direction (step S4).

Then, if the drawing control unit 815 does not determine that the tilt direction of the pen tip axis SL of the pen tip 412 is the first tilt direction (step S4; NO), the drawing control unit 815 operates the pen rotation motor 443 to set the tilt direction of the pen tip axis SL of the pen tip 412 to the first tilt direction (step S5).

On the other hand, if the drawing control unit 815 determines that the drawing position is in the right side in the width direction of the nail T (step S3; NO), next, the drawing control unit 815 determines whether the tilt direction of the pen tip axis SL of the pen tip 412 is the second tilt direction that the pen tip axis SL is tilted to the left side with respect to the vertical direction (step S6).

If it is not determined that the tilt direction of the pen tip axis SL of the pen tip 412 is the second tilt direction (step S6; NO), the drawing control unit 815 operates the pen rotation motor 443 to set the tilt direction of the pen tip axis SL of the pen tip 412 to the second tilt direction (step S7).

Then, the drawing control unit 815 reads the position correction value from the position correction value storage area 825 of the storage unit 82 and corrects the position of the pen tip 412 according to the read value (step S8).

If it is determined that the drawing position is in the left side in the width direction of nail T (step S3; YES) and the tilt direction of the pen tip axis SL of the pen tip 412 is the first tilt direction (step S4; YES); if the tilt direction of the pen tip axis SL of the pen tip 412 is the second tilt direction and set to be the first tilt direction (step S5); if the drawing position is in the right side in the width direction of the nail T (step S3; NO) and it is determined that the tilt direction of the pen tip axis SL of the pen tip 412 is the second tilt direction (step SE; YES); and if the tilt direction of the pen tip tilt direction SL of the pen tip 412 is the first tilt direction and set to the second tilt direction and the pen position is corrected (step S8), the drawing control unit 815 starts drawing by the drawing unit 40 (step S9).

During the drawing operation, the drawing control unit 815 determines whether the drawing operation for the nail T is finished as needed (step S10).

If it is not determined that the drawing operation is finished (step S10; NO), the processing returns to step S3 to repeat the above processing until the drawing operation is finished.

If it is determined that the drawing operation is finished (step S10; YES), the drawing processing is ended.

As described above, according to the nail print apparatus 1 in the embodiment, when performing drawing on at least right end portion of the surface of the nail T by controlling the tilt direction of the pen tip axis SL of the pen tip 412 of the pen 41 and the drawing operation by the pen 41, the drawing is performed by setting at least the pen tip 412 which is the tip portion of the pen 41 to be in the second tilt direction that the pen tip axis SL is tilted to the left side with respect to the vertical direction. When drawing is performed on at least left end portion of the nail T surface, the drawing is performed by setting at least the pen tip 412 which is the tip portion of the pen 41 to be in the first tilt direction that the pen tip axis SL is tilted to the right side with respect to the vertical direction.

Thus, when performing drawing on the nail T surface having a curved shape that the central portion is raised compared to the both end sides along the horizontal direction which is the width direction, it is possible to perform highly accurate nail printing even for the end portions by suppressing the blur and break of the line on the end portions of nail T.

In the embodiment, the direction of the pen tip 412 is reversed by rotating the pen 41 by 180 degrees around its axis with the pen rotation motor 443 forming the drawing tool driving unit. Thus, it is possible to achieve drawing which is beautiful even at the end portions by a relatively simple mechanism.

The drawing control unit 815 in the embodiment changes the tilt direction of the pen tip axis SL of the pen tip 412 which is the tip portion of the pen 41 on the basis of the central position in the width direction of the surface of nail T as the switching position CP. Thus, it is possible to achieve highly accurate nail printing by a relatively simple control.

[Second Embodiment]

Next, the second embodiment of the nail print apparatus and the drawing control method thereof according to the present invention will be described with reference to FIGS. 7A to 7C.

The embodiment is different from the first embodiment only in the switching position for changing the tilt direction of the pen tip axis of pen tip. Thus, in the following description, the respects different from the first embodiment are mainly described.

Figure 7A:
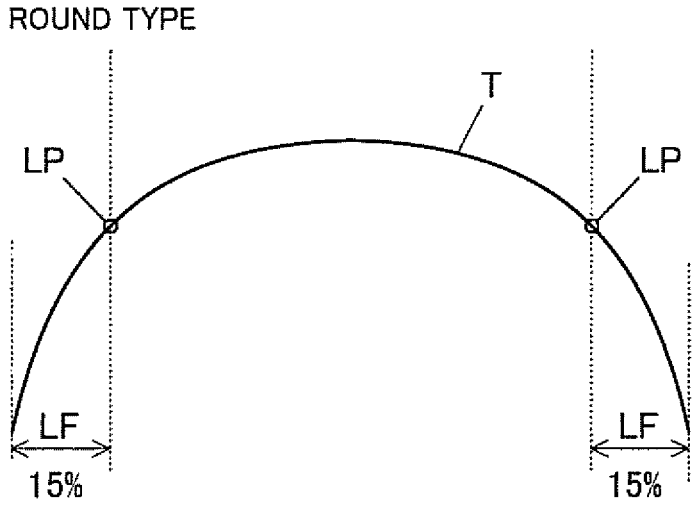
FIG. 7A is a view for explaining drawing processing of the nail print apparatus according to the second embodiment.
Figure 7B:
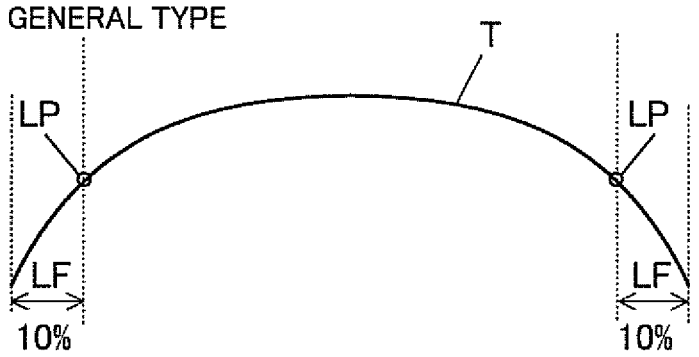
FIG. 7B is a view for explaining drawing processing of the nail print apparatus according to the second embodiment.
Figure 7C:
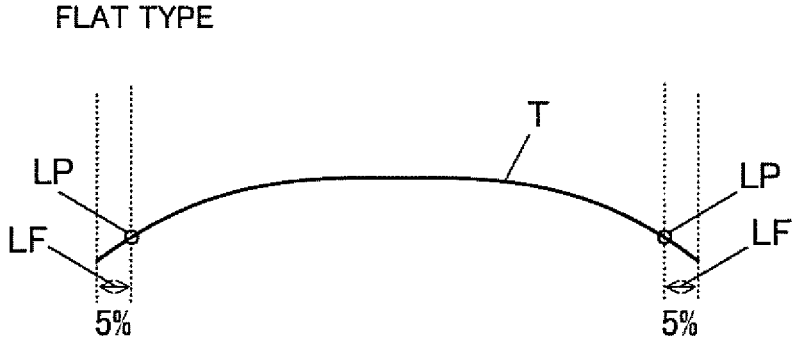
FIG. 7C is a view for explaining drawing processing of the nail print apparatus according to the second embodiment.

In the embodiment, as shown in FIGS. 7A to 7C, the drawing control unit 815 sets, as a switching position LP, the position horizontally shifted from the left or right end portion in the width direction of nail T surface toward the central portion for a predetermined setting distance LF. Then, the drawing control unit 815 changes the tilt direction of the pen tip axis SL of the pen tip 412 which is the tip portion of the pen 41 on the basis of the switching position LP as the border.

The drawing control unit 815 sets a horizontal setting distance LF of the switching position LP from an end portion in the width direction of nail T surface according to the nail shape detected by the nail information detecting unit 812.

That is, in the embodiment, the nail information detecting unit 812 also obtains the slant angle (nail curvature) of nail T as nail information.

Then, according to the slant angle (nail curvature), the shape in the width direction of nail T surface (shape corresponding to the nail curvature or the like) is classified as any one of a plurality of patterns which are set in advance, and the horizontal setting distance LF of the switching position LP from an end portion of nail T is set according to the classified pattern.

Specifically, a plurality of patterns which are different from each other in slant angle (nail curvature) are set in advance for the shape in width direction of nail T surface, and a table or such like specifying a horizontal distance LF of the switching position LP of pen tip 412 from an end portion of nail T is stored in the storage unit 82 for each of the patterns.

For example, as shown in FIGS. 7A to 7C, three patterns of "round type" having a large curvature, "general type" having a curvature smaller than that of the "round type" and a "flat type" having a curvature further smaller than the "general type" and being relatively flat are set in advance as the shape in width direction of nail. T surface.

Here, when the shape in width direction of nail T surface is the pattern of "round type" shown in FIG. 7A, the horizontal distance of 15% with respect to the width of nail T from an end portion is set as the setting distance LF, and the position corresponding to the setting distance LF is set as the switching position LP.

When the shape in width direction of nail T surface is the pattern of "general type" shown in FIG. 7B, the horizontal distance of 10% with respect to the width of nail T from an end portion is set as the setting distance LF, and the position corresponding to the setting distance LF is set as the switching position LP.

When the shape in width direction of nail T surface is the pattern of "flat type" shown in FIG. 7C, the horizontal distance of 5% with respect to the width of nail T from an end portion is set as the setting distance LF, and the position corresponding to the setting distance LF is set as the switching position LP.

The drawing control unit 815 determines which of the patterns is applied to the shape in width direction of nail T surface that is the drawing target on the basis of the nail information detected by the nail information detecting unit 812. Then, the drawing control unit 815 sets the switching position LP to the position corresponding to the setting distance LF associated with the pattern, and controls the pen rotation motor 443 so as to change the tilt direction of pen tip axis SL of pen tip 412 when the drawing position crosses the set switching position LP.

Since the other configurations are similar to those of the first embodiment, the explanation thereof is omitted.

Next, operations of nail print apparatus 1 and the drawing control method in the embodiment will be described.

First, similarly to the first embodiment, the photographing unit 50 obtains images (nail images) of nail T of the printing finger U1 inserted into the finger receiving unit 31 before starting the drawing operation.

Then, the nail information detecting unit 812 detects the nail information such as the shape of nail T (curvature) on the basis of the nail images.

When the nail information detecting unit 812 detects the nail information such as shape (curvature) of nail T, on the basis of the detected nail information, the control unit 81 classifies the shape in width direction of nail T surface as any one of the plurality of patterns such as the "round type", "general type" and "flat type" which are set in advance.

The drawing control unit 815 sets the switching position LP in the nail T by referring to a table specifying the correspondence between the plurality of patterns of nail T and the respective setting distances LF for switching positions LP of tilt direction of pen tip axis SL of pen tip 412 which is stored in the storage unit 82.

The drawing unit 815 makes the drawing unit 40 perform drawing while appropriately changing the tilt direction of pen tip axis SL of pen tip 412 according to the location of drawing position in the width direction of nail T.

That is, for example, if the nail T shape is classified as the "round type", when the drawing position is located within the range in the left side (central portion side) with respect to the position having the horizontal distance of 15% of nail T width from the right end, the drawing control unit 815 performs drawing by setting the pen. 41 in the first tilt direction that the pen tip axis SL of the pen tip 412 is tilted to the right with respect to the vertical direction.

Then, when the drawing position becomes within the range of the distance of 15% from the right end, the drawing control unit 815 sets the pen 41 in the second tilt direction that the pen tip axis SL of the pen tip 412 is tilted to the left with respect to the vertical direction, and performs drawing to the right end portion.

Since the other respects are similar to those of the first embodiment, the explanation thereof is omitted.

As described above, according to the embodiment, in addition to the effects similar to those of the first embodiment, the following effects can be obtained.

That is, in the embodiment, the drawing control unit 815 changes the tilt direction of pen tip axis SL of pen tip 412 of pen 41 on the basis of the position, as the switching position, shifted toward the central portion for a predetermined width from left or right end portion in the width direction of nail T surface.

Here, at the switching position for tilt direction of pen tip axis SL of pen tip 412, the direction to apply ink is changed, and thereby, the shape of applied line is disturbed and the shape of nail design and such like are disturbed at the position in some cases. With respect to this, in the embodiment, the tilt direction of pen tip axis SL of pen tip 412 is changed at the portion close to the end portion, not the central portion in the width direction of nail T, and thus, the position where the shape and such like of nail design are disturbed due to the switching position of tilt direction of pen tip axis SL of pen tip 412 can be a relatively obscure position. Thus, it is possible to perform nail printing with a relatively beautiful finish.

Here, the setting distance LF of the switching position LP for tilt direction of pen tip axis SL of pen tip 412 from an end portion of nail T is set according to the shape of nail T detected by the nail information detecting unit 812.

Thus, it is possible to change the tilt direction of pen tip axis of pen tip at the position suitable for the shape of nail T of each user.

For example, when the nail T is a nail in a flat shape, drawing can be performed with little change of the tilt direction of pen tip axis of pen tip 412. Thus, in such case, the setting distance LF is set to be the position closer to the end portion such as a position of 5% from an end portion of nail T. Thus, the switching position is set to be more obscure position and it is possible to achieve a beautiful finish.

[Third Embodiment]

Next, the third embodiment of the nail print apparatus and the drawing control method thereof according to the present invention will be described.

The embodiment is different from the first and second embodiments only in the switching position for changing the tilt direction of pen tip axis of pen tip. Thus, in the following description, the respects different from those of the first embodiment and the second embodiment are mainly described.

In the embodiment, the drawing control unit 815 does not perform the determination regarding the shape of width direction of nail T surface which is the drawing target as in the second embodiment, and sets, as the switching position LP, the position horizontally shifted from the left or right end portion in width direction of nail T surface toward the central portion for a distance of a fixed rate which is set in advance with respect to the width of nail T. When the drawing position crosses the switching position LP, the drawing control unit 815 changes the tilt direction of pen tip axis SL of pen tip 412 which is the tip portion of the pen 41.

The switching position LP is set according to the nail T having the largest curvature among shapes predicted to be a shape of general nail T.

Though the distance of the switching position LP from the end portion in the width direction of nail T surface is not especially limited, for example, the distance is set to be the length of 15% of the width of nail T from an end portion of nail T.

Since the other configurations are similar to those of the first embodiment and the second embodiment, the explanation thereof is omitted.

As described above, according to the embodiment, in addition to the effects similar to those of the first embodiment, the following effects can be obtained.

That is, in the embodiment, the switching position is set to be the position shifted toward the central portion for a predetermined distance from the left or right end portion in the width direction of the nail T surface so that the drawing control unit 815 changes the tilt direction of the pen tip axis 413 of the pen tip 412 which is the tip portion of the pen 41.

At the switching position of the tilt direction of the pen tip axis 413 of the pen tip 412, the shape of the applied line is disturbed due to the change of direction to apply the ink and such like, and the shape of nail design and such like is disturbed at the position in some cases. With respect to this, in the embodiment, the tilt direction of the pen tip axis 413 of the pen tip 412 is changed at the portion close to the end portion, not the central portion in the width direction of nail T, and thus, the position where the shape of nail design and such like are disturbed due to the switching position can be a position which is relatively obscure. Thus, it is possible to perform nail printing with a relatively beautiful finish.

Furthermore, in the embodiment, the switching position is uniformly set according to the nail T with the largest curvature among curvatures predicted as a shape of general nail T.

Thus, drawing processing can be performed without providing processes such as detecting and classifying the shapes of nails T of respective users, and it is possible to achieve, with a relatively simple configuration, nail printing with a beautiful finish that the disturbance of the shape of nail design and such like due to the switching position for the tilt direction of the pen tip axis 413 of pen tip 412 is obscure.

[Fourth Embodiment]

Next, with reference to FIGS. 8, 9A and 9B, the fourth embodiment of the nail print apparatus and the drawing control method thereof according to the present invention will be described.

The embodiment is different from the first to third embodiments only in the mechanism for changing the tilt direction of the pen tip axis of pen tip. Thus, in the following description, the respects different from the first to third embodiments will be mainly described.

Figure 8:
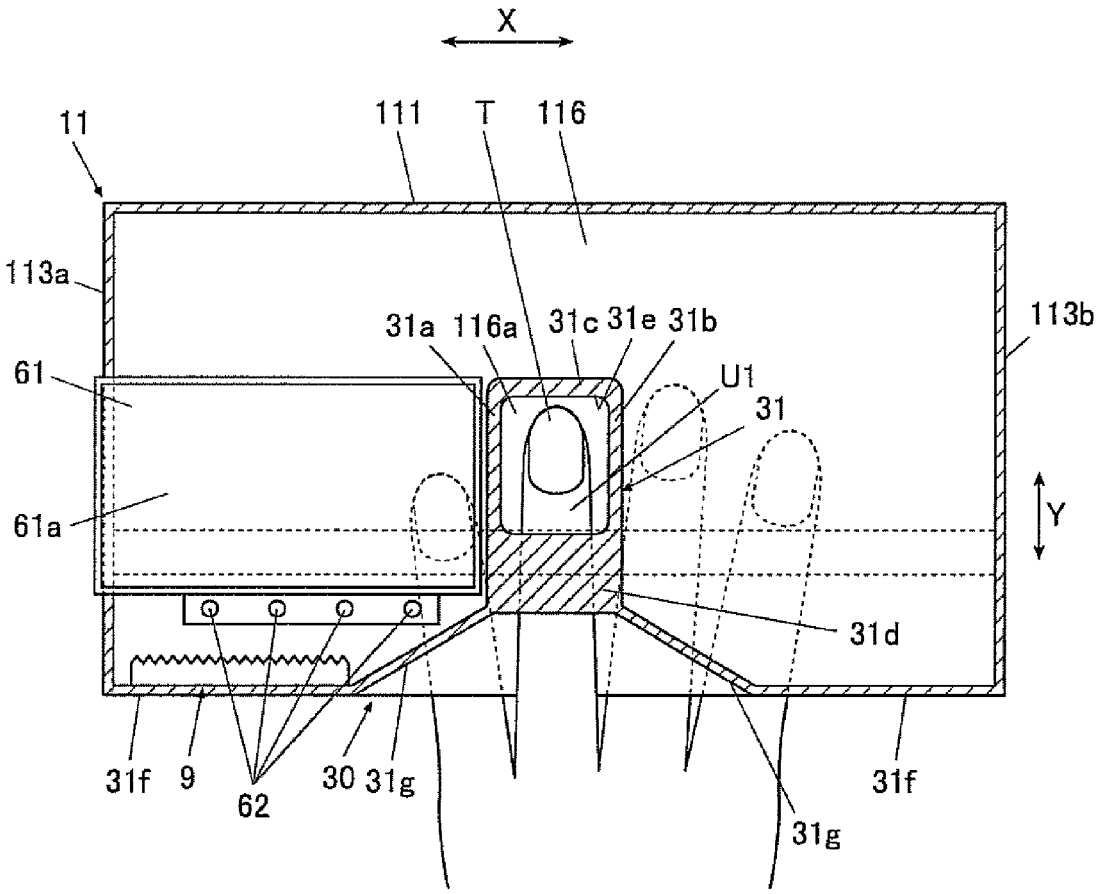
FIG. 8 is a sectional view showing main parts of a nail print apparatus in a fourth embodiment.

FIG. 8 is a sectional view showing main parts in the embodiment.

As shown in FIG. 8, in the embodiment, a gear plate member 9 is provided at the inner side of the front wall 31*f* on the upper surface of the dividing wall 116 as a mechanism for reversing the tilt direction of the pen tip axis 413 of pen tip 412 which is the tip portion of pen 41.

In the embodiment, the gear plate member 9 is a plate-like member extending in the X direction which is the width direction of nail print apparatus, and disposed to be fixed on the wall surface at an upper section of the home space in which the pen test writing unit 61 and the pen caps 62 are provided, for example.

The gear plate member 9 has irregularities (gear) on the surface facing the drawing head 42 to be engaged with the rotation gear 417 which is the first rotation mechanism provided at the pen 41, and the gear plate member 9 is a second rotation mechanism.

The pen 41 held by the drawing head 42 is moved in the longer direction of the gear plate member 9 (X direction which is the width direction of nail print apparatus as shown in FIG. 8 in the embodiment) with the rotation gear 417 contacting the gear plate member 9, and thereby, the rotation gear 417 is engaged with the irregularities (gear) of the gear plate member 9 to be rotated. Thus, the pen 41 is rotated around the axis CL of the pen shaft 411, and the tilt direction of the pen tip axis SL of the pen tip 412 is changed.

Preferably, the irregularities (gear) of the gear plate member 9 are disposed at the position close to the inner side of apparatus for approximately several millimeters from the front wall 31*f* so as to easily contact the rotation gear 417, and a member having some thickness is preferable.

Though the position to provide the gear plate member 9 is not limited to the illustrated example, it is preferable to dispose the gear plate member 9 at a position where the gear plate member 9 can contact the rotation gear 417 only when the pen 41 is lifted up to be rotatable.

That is, in the embodiment, the pen 41 is held to be rotatable inside the pen holder 431 when the pen 41 is lifted up to be at the non-drawing position by the pen holding unit 437*d*, and when the pen 41 is in this state, the gear plate member 9 can contact the rotation gear 417.

The length and width of the gear plate member 9 are not limited to the illustrated example, and the gear plate member 9 only needs to have at least the length and width necessary to contact the rotation gear 417 to rotate the pen 41 by 180 degrees and to reverse the left and right tilt direction of the pen tip axis 413 of pen tip 412.

With respect to this, in order to rotate the pen 41 180 degrees and reverse the tilt direction of the pen tip axis 413 of pen tip 412, the length F of the gear plate member 9 needs to satisfy $A \times \pi/2 \leq F$ when the diameter of the rotation gear 417 is A. Therefore, for example, when the diameter of rotation gear 417 is 10 mm, as the length F of the gear plate member 9, at least 16 mm is enough.

As shown in FIGS. 9A, 9B, 12A and 12B, when the gear plate member 9 is long to the same degree as the width of the drawing head 42, it is possible to change the directions of all the pens 41 at once by making the rotation gears 417 of all the pens 41 held in the pen carriages 43 in the drawing head 42 contact the gear plate member 9 all at once and moving the drawing head 42 in this state.

When tilt directions of pen tip axis 413 are to be changed for only a part of the pens 41 in a case where the long gear plate member 9 is provided as described above, only the pens 41 that the tilt directions are not to be changed may be lowered by the pen lifting mechanism 432 so that the rotation gears 417 of the pens 41 will not contact the gear plate member 9.

Since the other configurations are similar to those of the first to third embodiments, the explanation thereof is omitted.

Next, with reference to FIGS. 9A and 9B, operations and drawing control method of the nail print apparatus in the embodiment will be described.

In the embodiment, similarly to the first to third embodiments, the drawing control unit 815 appropriately changes the tilt direction of pen tip axis 413 of pen tip 412 to perform drawing with the drawing unit 40 in accordance with the location of the drawing position in the width direction of nail T.

When determining that the tilt direction of pen tip axis 413 of pen tip 412 needs to be changed, the drawing control unit 815 operates the head driving unit 49 to move the drawing head 42 to the position where the gear plate member 9 is provided.

Figure 9B:
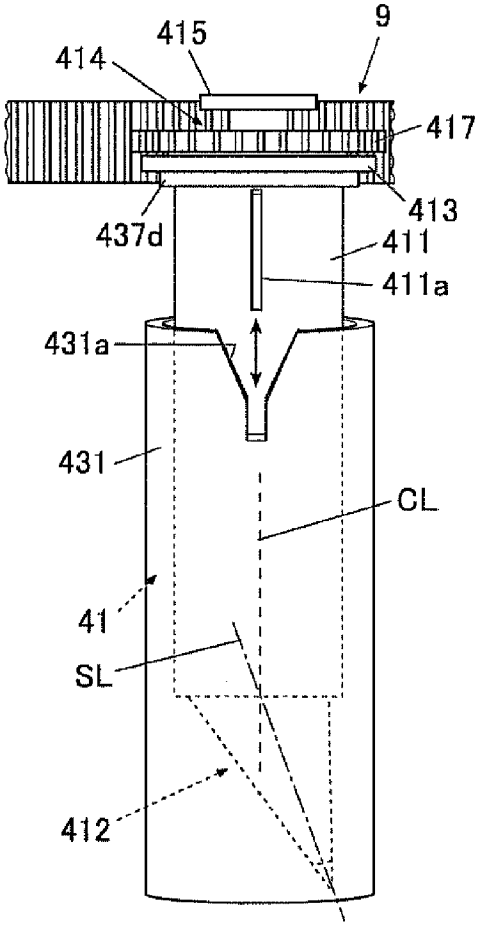
FIG. 9B is a main part lateral view of a pen and a gear plate member in the fourth embodiment showing a state in which the pen tip axis of the pen tip is tilted to the right.
Figure 9A:
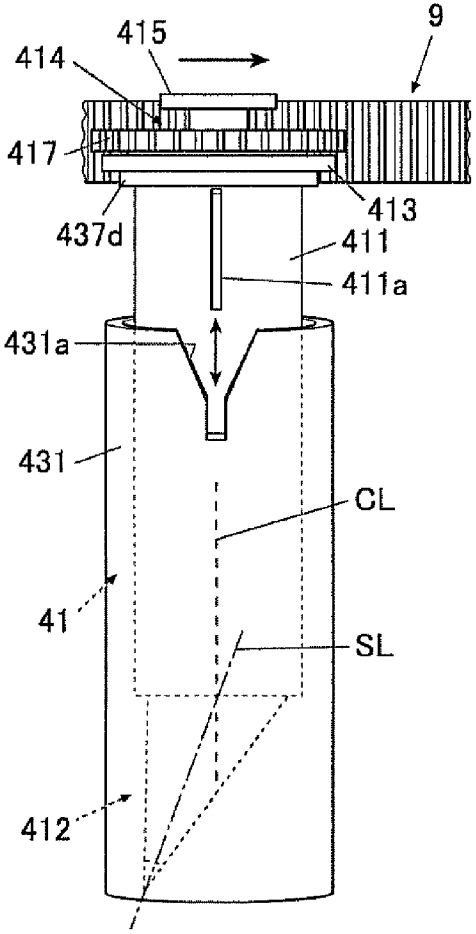
FIG. 9A is a main part lateral view of a pen and a gear plate member in the fourth embodiment showing a state in which the pen tip axis of the pen tip is tilted to the left.

Then, as shown in FIG. 9A, the drawing control unit 815 makes the rotation gear 417 of pen 41 contact the gear plate member 9 in the non-drawing state that the pen 41 is lifted up by the pen lifting mechanism 432 and the locking convex portion 411*a* of the pen shaft 411 is not locked into the notch 431*a* of the pen holder 431.

In this state, the drawing control unit 815 operates the head driving unit 49 to move the drawing head 42 in the arrow direction shown in FIG. 9A until the tilt direction of the pen tip axis 413 of pen tip 412 of pen 41 is reversed.

For example, when the diameter of rotation gear 417 is 10 mm, the drawing head 42 is moved for about 16 mm in the X direction (horizontal direction of nail print apparatus 1) from the position where the rotation gear 417 contacts the gear plate member 9.

Thus, as shown in FIG. 9B, the pen 41 is rotated approximately 180 degrees around the axis thereof and the tilt direction of pen tip axis 413 of pen tip 412 is horizontally reversed.

When the direction of the pen tip 412 is reversed, the drawing control unit 815 operates the head driving unit 49 to move the drawing head 42 in the back direction (back side in Y direction in FIG. 13) of the apparatus to the position where the rotation gear 417 does not contact the gear plate member 9.

Then, at this position, or after moving the pen 41 to the drawing position, the drawing control unit 815 lowers the pen 41 by the pen lifting mechanism 432 (for example, the solenoid 440 of the pen lifting mechanism 432 is turned off to make the pen 41 fall down by its own weight).

Thus, the pen 41 is in the drawable state that the locking convex portion 411*a* of the pen shaft 411 is locked into the notch 431*a* of pen holder 431, the tilt direction of pen tip axis 413 of pen tip 412 is fixed and the pen tip 412 protrudes from the lower end of the pen holder 431. The drawing control unit 815 performs drawing in this state.

Since the other respects are similar to those of the first to third embodiments, the explanation thereof is omitted.

As described above, according to the embodiment, in addition to the same effects as the first to third embodiments, the following effects can be obtained.

That is, in the embodiment, a gear plate member 9 is provided to be fixed in the nail print apparatus, and by moving the drawing head 42 with the gear plate member 9 contacting the rotation gear 417 of pen 41, the tilt direction of pen tip axis 413 of pen tip 412 can be changed.

Thus, there is no need to separately prepare a driving mechanism dedicated for rotating the pen 41. Thus, it is possible to simplify the configuration of apparatus to be compact and light and suppress the apparatus cost.

In a case where a long member is used as the gear plate member 9, the tilt directions of the pen tip axes 413 of pen tips 412 can be changed all at once for a plurality of pens 41, and it is possible to rapidly and efficiently change the tilt directions of pen tip axes 413 of pen tips 412.

In the above description, the gear plate member 9 is disposed to be fixed on the wall surface in the upper section of home space. However, the gear plate member 9 may be provided at any position as long as the rotation gear 417 of pen 41 can contact the irregularities (gear) of the gear plate member 9. For example, depending on the shapes of drawing head 42 and pen holder 431, the gear plate member 9 may be disposed on the wall surface of back surface (upper side in FIG. 8) of nail print apparatus or left or right lateral surface (left or right lateral surface in FIG. 8). Alternatively, the gear plate member 9 may be vertically provided from the upper side of the nail print apparatus.

In the embodiment, a gear plate member 9 having irregularities (gear) on the surface thereof is disposed and the rotation gear 417 of the pen 41 is engaged with the irregularities (gear) of the gear plate member 9. However, the shapes and configurations of the gear plate member 9 and the rotation gear 417 are not limited to this.

For example, the surface of gear plate member 9 and the rotation gear 417 of pen 41 may be processed to be roughed at the outer lateral surfaces without forming irregularities (gear). Alternatively, a material such as rubber having a large friction coefficient may be attached to the surface of gear plate member 9 and the outer lateral surface of the rotation gear 417 so that the pen 41 is rotated by a friction force when the surface of gear plate member 9 contacts the outer lateral surface of the rotation gear 417 of the pen 41.

Though the embodiments of the present invention have been described, it goes without saying that the present invention is not limited to the embodiments and various changes can be made within the scope of the invention.

For example, the embodiments have been described by illustrating a case where the rotation gear 417 is provided between the flange 413 and the finger grip 415. However, the position to provide the rotation gear 417 is not limited to this.

For example, a gear portion to be engaged with the gear of motor gear 445 may be formed on the outer circumferential surface of the flange 413 without separately providing the rotation gear 417.

Figure 10:
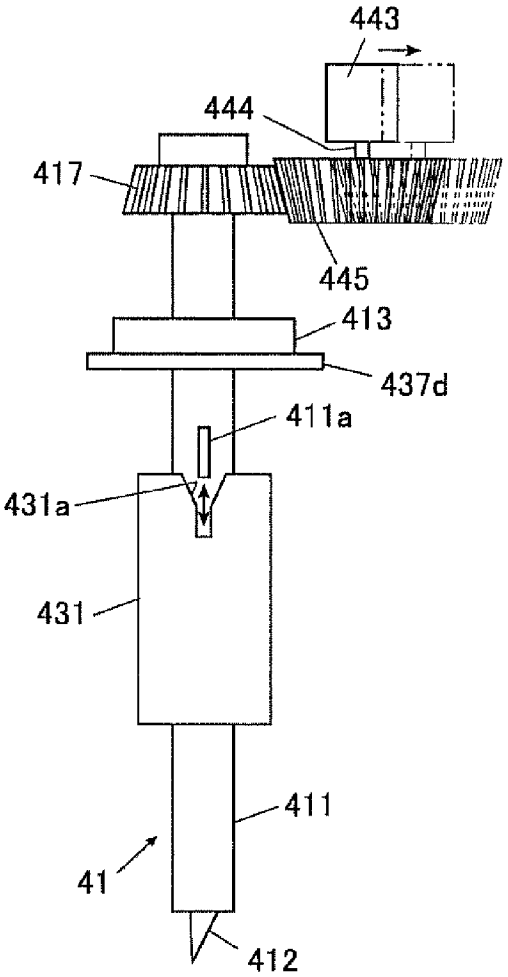
FIG. 10 is a front view showing a modification example of a pen rotation motor.

As shown in FIG. 10, the rotation gear 417 may be provided around the upper end portion of the pen 41 above the flange 413.

The shape of rotation gear 417 is also not especially limited. For example, as shown in FIG. 10, the rotation gear 417 may be formed so as to have a larger diameter downward. In this case, the motor gear 445 to be engaged with the rotation gear 417 is also formed to match the shape of the rotation gear 417 (that is, a slant angle of lateral surface of rotation gear 417) so as to have a larger diameter upward.

As shown in FIG. 10, in a case where the rotation gear 417 has a larger diameter downward, by providing the detachment portion 445*b* (see FIG. 4D) to the motor gear 445, the pen 41 can be lowered when the engagement between the gears is released. However, the pen 41 cannot be removed upward. Thus, as indicated by the two dot chain line in FIG. 10, when the pen 41 is to be replaced or such like, the motor gear 445 together with the pen rotation motor 443 is made to retreat to the position not contacting the pen 41 by providing a unit which moves the motor gear 445 and the pen rotation motor 443 connected thereto via a shaft 444 in the direction away from the pen 41.

The configuration of the pen 41 which is the writing tool is not limited to that shown in FIGS. 3A to 3E.

Figure 11A:
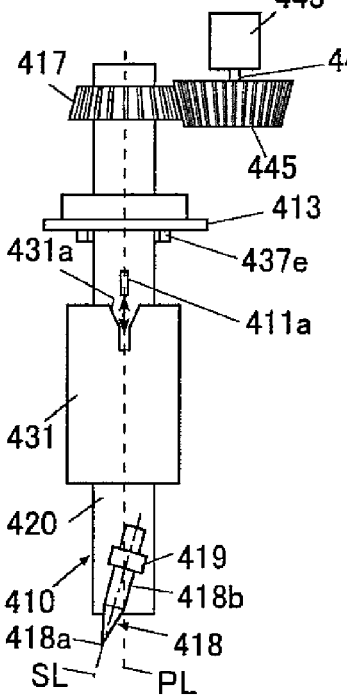
FIG. 11A is a front view showing a modification example of a pen and showing a state in which the pen tip axis of the pen tip is tilted to the left.

For example, as shown in FIG. 11A, a pen 410 may be configured by including a pen holding shaft 420 and a pen main body 418 as a writing tool main body which has a cylindrical pen shaft 418*b* provided at the tip portion of the pen holding shaft 420 and a pen tip 418*a* as a tip portion provided at the tip portion of the pen shaft 418*b*.

In this case, the pen tip axis SL of the pen tip 418*a* of the pen main body 418 is not tilted with respect to the axis of the pen shaft 418*b*. That is, the pen main body 418 has a general shape that the pen tip axis SL of the pen tip 418*a* is along the axis of the pen shaft 418*b*.

The pen main body 418 is fixed to the pen holding shaft 420 by a pen fixing unit 419 in a state in which the pen tip axis SL is tilted with respect to the axis PL of the pen holding shaft 420.

The pen holding shaft 420 may be a solid bar or a hollow tube.

The pen holding shaft 420 is inserted to be held in the pen holder 431 of the pen carriage 43, and the drawing control unit 815 rotates the pen holding shaft 420 of the pen 410 inserted into the pen holder 431.

Figure 11B:
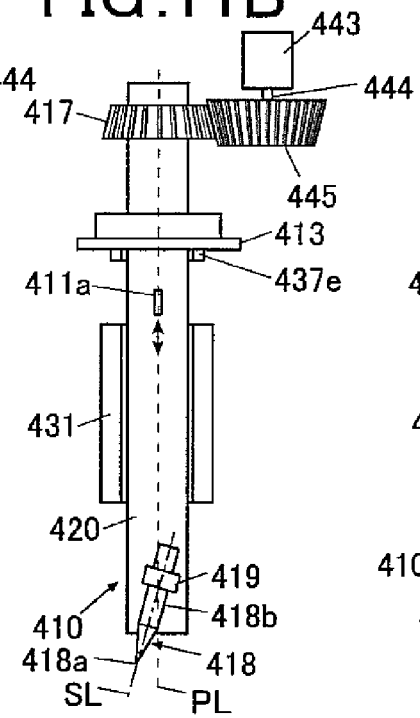
FIG. 11B is a front view showing a modification example of a pen and showing a state in which the pen tip axis of the pen tip is tilted to the left.
Figure 11C:
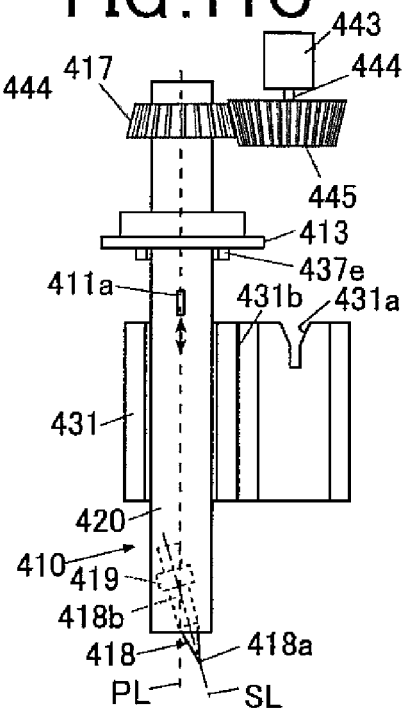
FIG. 11C is a front view showing a modification example of a pen and showing a state in which the pen tip axis of the pen tip is tilted to the right.

In this case, as shown in FIGS. 11B and 11C, the tilt direction of the pen tip axis SL of the pen tip 418*a* can be reversed by rotating the pen holding shaft 420 of the pen 410 inserted into the pen holder 431 by 180 degrees.

In this case, since the pen main body 418 protrudes outside the pen holding shaft 420, for example, as shown in FIG. 11B, the pen holder 431 may be shaped to be open at the side provided with the pen main body 418 so that the pen holder 431 of the drawing head 42 holds the pen 410 so as to sandwich the pen 410 from both sides.

In this case, a pen holding unit 437*e* provided at the tip portion of the longer arm 437*b* of the pen lifting lever 437 of the pen lifting mechanism 432 is formed in a nearly C shape or U shape with the side provided with the pen main body 418 open, for example.

In this case, for example, a standby space is provided at the upper surface of the dividing wall 116, a plurality of pens 410 are held in the standby space, and a pen 410 is automatically selected from the standby space to be loaded on the drawing head 42.

By such configuration, the pen 410 can be held by the drawing head 42 even in the configuration that the pen main body 418 protrudes outside the pen holding shaft 420.

In this case, only a single drawing head 42 is needed. Thus, it is possible to increase the number of pens 410 which can be held in the nail print apparatus 1 while making the apparatus light.

The configuration of pen holder 431 holding the pen 410 with the pen main body 418 protruding outside the pen holding shaft 420 is not limited to this.

For example, as shown in FIG. 11C, the pen holder 431 may include a hinge 431*b* so that the pen holder 431 is operable and closable via the hinge 431*b* to be in a closed state (see FIG. 11A) for sandwiching therein the pen holding shaft 420 and in an open state (see FIG. 11C) for releasing the pen holding shaft 420.

Alternatively, the pen holder may be integrally provided with the pen 410 so as to be attached/detached when the pen 410 is replaced or the like.

As in FIGS. 11A to 11C, in a case where the pen 410 has a configuration of fixing the pen main body 418 including the pen tip 418*a* to the pen holding shaft 420 so as to be tilted, a commercial pen in a normal shape can be used as the pen main body 418. Thus, pens can be manufactured at low cost compared to pens having the pen tips tilted.

Figure 12A:
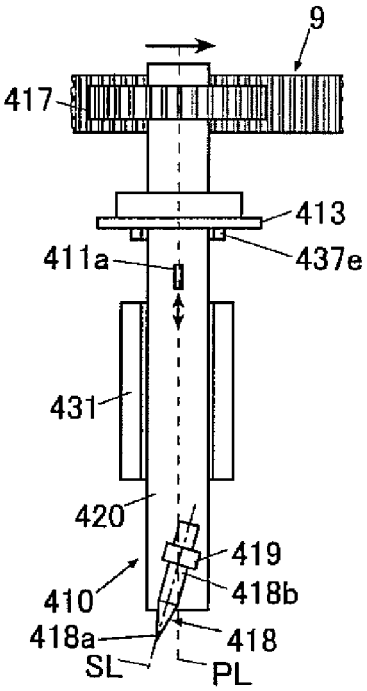
FIG. 12A is a main part lateral view of a pen and a gear plate member showing, as an example, a case where the modification example of the pen shown in FIGS. 11A to 11C is applied to the fourth embodiment, and showing a state in which the pen tip axis of the pen tip is tilted to the left.
Figure 12B:
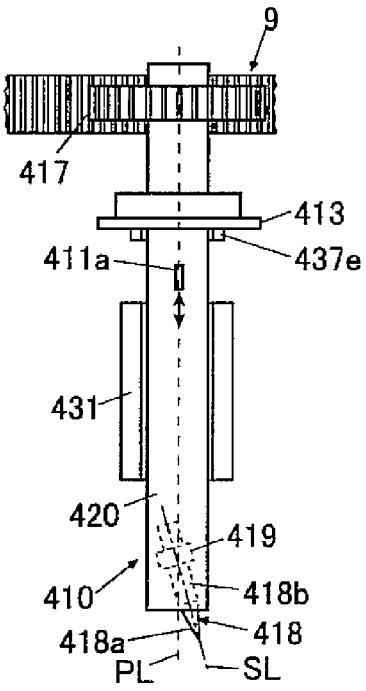
FIG. 12B is a main part lateral view of a pen and a gear plate member showing, as an example, a case where the modification example of the pen shown in FIGS. 11A to 11C is applied to the fourth embodiment, and showing a state in which the pen tip axis of the pen tip is tilted to the right.

As shown in FIGS. 12A and 12B, the configuration of including a gear plate member 9 fixed in the apparatus and rotating the pen 41 by making the gear plate member 9 contact the rotation gear 417 and moving the pen 41 in the longer direction of the gear plate member 9 as in the fourth embodiment may be applied to the configuration in which the pen main body 418 is fixed to the pen holding shaft 420 so as to be tilted.

In this case, as shown in FIGS. 12A and 12B, the pen 410 can be held in the pen holder 431 so as to be rotatable, and it is possible to reverse the tilt direction of the pen tip axis SL of the pen tip 418*a* only by moving the pen 410 (pen holder 431 holding the pen 410) in a state in which the rotation gear 417 contacts the gear plate member 9.

The embodiments have been described by illustrating a case where the tilt direction of the pen tip axis of pen tip is changed according to the drawing position of nail T to perform drawing by rotating the pen 41 by 180 degrees around the axis thereof and thereby reversing the tilt direction of pen tip axis SL of the pen tip 412 which is the tip portion. However, the method for changing the tilt direction of pen tip axis of pen tip to perform drawing is not limited to this.

For example, there may be provided a first pen including a pen tip with the pen tip axis tilted to the right and a second pen including a pen tip with the pen tip axis tilted to the left, and drawing may be performed by using the first pen and the second pen depending on the drawing position.

The embodiments have been described by illustrating a configuration using solenoids as pen lifting mechanism for moving the pens 41 and 410 up and down. However, the configuration of pen lifting mechanism is not limited to this. For example, the pen lifting mechanism may be configured by a stepping motor, a DC motor, a motor and a ball screw.

The embodiments have been described by taking an example in which the X-direction movement stage 45 and the Y-direction movement stage 47 for moving the drawing head 42 are configured by combining the X-direction movement motor 46 and the Y-direction movement motor 48 which are stepping motors with the ball screw and the guide not shown in the drawings. However, the configuration for moving the drawing head 42 is not limited to this.

The X-direction movement motor 46 and the Y-direction movement motor 48 may be anything as long as they can move the drawing head 42 forward and backward and left and right at will. For example, the configuration may use a mechanism using a shaft, guide and wire as used in conventional inexpensive printers. Alternatively, the configuration may use a servomotor or the like.

The embodiments have been described by taking, as an example, the nail print apparatus 1 which performs drawing in order by inserting a single finger into the apparatus.

However, the present invention can also be applied to an apparatus which can perform drawing continuously with respect to a plurality of fingers without inserting and removing each of the fingers.

For example, by enlarging the movable range of pen to increase the drawable range, drawing can also be performed continuously with respect to each of the fingernails in a state in which a plurality of printing fingers U1 are inserted at the same time.

Though several embodiments of the present invention have been described above, the scope of the present invention is not limited to the above embodiments, and includes the scope of inventions, which is described in the scope of claims, and the scope equivalent thereof.

What is claimed is:

1. A drawing apparatus, comprising:

a placement section including a placement surface on which a printing target object having a printing target surface is placed, a drawing head in which at least one drawing tool having a drawing tool shaft and a tip portion provided at one end of the drawing tool shaft is loaded and performs drawing on the printing target surface by making one end of the tip portion contact with a drawing position of the printing target surface, the tip portion having a shape including a first axis as a central axis; and a control unit which performs control to change a direction of the first axis of the tip portion of the drawing tool loaded in the drawing head with respect to a surface direction of the placement surface according to the drawing position of the printing target surface, wherein the drawing tool shaft of the drawing tool has a shape with a second axis as a central axis, and the first axis is tilted with respect to the second axis, wherein the drawing head has a first rotation mechanism which rotates the drawing tool shaft around the second axis, wherein the drawing apparatus has a second rotation mechanism which is provided to be contractable with the first rotation mechanism, and wherein in a state in which contact between the first rotation mechanism and the second rotation mechanism is maintained, by moving the drawing tool with respect to the second rotation mechanism, the control unit performs control to rotate the drawing tool shaft of the drawing tool around the second axis by the first rotation mechanism and change a direction of the first axis with respect to the surface direction of the placement surface.

2. The drawing apparatus according to claim 1, wherein the printing target surface is curved along a first direction and has a first end portion and a second end portion being both ends along the first direction, wherein the control unit sets a switching position at one position shifted from the first end portion toward a central portion in the first direction for a preset distance along the first direction, and wherein the control unit performs control to change the direction of the first axis according to whether the drawing position is located between the switching position and the first end portion or between the switching position and the second end portion.

3. The drawing apparatus according to claim 2, wherein the control unit sets the switching position to be a center position in the first direction of the drawing target surface.

4. The drawing apparatus according to claim 2, wherein the control unit detects a value of an slant angle of the first end portion of the drawing target surface and sets the switching position between the first end portion of the printing target surface and a center position in the first direction of the drawing target surface according to the value of the slant angle.

5. The drawing apparatus according to claim 1, wherein the drawing head has a drawing tool holder having a tubular shape, wherein the drawing tool is inserted into the drawing tool holder and is there held, and wherein the control unit controls the direction of the first axis by rotating the drawing tool held in the drawing tool holder around an axis of the drawing tool holder.

6. The drawing apparatus according to claim 5, wherein the printing target surface is curved along a first direction, wherein the drawing tool shaft of the drawing tool has at least one protruding portion formed on an outer circumferential surface thereof so as to protrude, wherein the drawing tool holder has two cut-out portions, wherein each of the two cut-out portions has a groove portion to fit the protruding portion, and wherein the two cut-out portions are respectively formed at a first position and a second position, the first position being a position where the protruding portion of the drawing tool fits in the groove portion to set the direction of the first axis of the tip portion to the first tilt direction in which the first axis is tilted to one side in the one direction from a vertical direction vertical to the surface direction of the placement surface, and the second position being a position where the protruding portion of the drawing tool fits in the groove portion to set the direction of the first axis of the tip portion to the second tilt direction in which the first axis is tilted to the other side in the one direction from the vertical direction.

7. The drawing apparatus according to claim 1, wherein the first rotation mechanism is a rotation gear; and wherein the second rotation mechanism is provided within a movable range of the drawing tool and has a concave-convex shape to be engaged with the rotation gear.

8. The drawing apparatus according to claim 1, wherein the printing target object is finger or toe, and the drawing target surface is a surface of a nail of the finger or a surface of a nail of the toe.

9. A drawing apparatus comprising:

a placement section including a placement surface on which a printing target object having a printing target surface is placed, a drawing head in which at least one drawing tool having a tip portion provided at one end is loaded and performs drawing on the printing target surface by making one end of the tip portion contact with a drawing position of the printing target surface, the tip portion having a shape including a first axis as a central axis; and a control unit which performs control to change a direction of the first axis of the tip portion of the drawing tool loaded in the drawing head with respect to a surface direction of the placement surface according to the drawing position of the printing target surface, wherein the drawing tool includes:

a drawing tool main body having the tip portion at one end thereof; and a holding shaft which has a shape with a second axis as a central axis and the drawing tool main body is attached to one side thereof, wherein the drawing tool main body is attached to the holding shaft in a direction that the first axis is tilted with respect to the second axis, wherein the drawing head has a first rotation mechanism which rotates the drawing tool shaft around the second axis, wherein the drawing apparatus has a second rotation mechanism which is provided to be contractable with the first rotation mechanism, and wherein in a state in which contact between the first rotation mechanism and the second rotation mechanism is maintained, by relatively moving the drawing tool with respect to the second rotation mechanism, the control unit performs control to rotate the holding shaft of the drawing tool around the second axis by the first rotation mechanism and change a direction of the first axis with respect to the surface direction of the placement surface.

10. The drawing apparatus according to claim 9, wherein the printing target surface is curved along a first direction, wherein the drawing head has a drawing tool holder having a tubular shape, wherein the holding shaft of the drawing tool is inserted into the drawing tool holder, wherein the holding shaft of the drawing tool has at least one protruding portion formed on an outer circumferential surface thereof so as to protrude, wherein the drawing tool holder has two cut-out portions, wherein each of the two cut-out portions has a groove portion to fit the protruding portion, and wherein the two cut-out portions are respectively formed at a first position and a second position, the first position being a position where the protruding portion of the drawing tool fits in the groove portion to set the direction of the first axis of the tip portion to the first tilt direction in which the first axis is tilted to one side in the one direction from a vertical direction vertical to the surface direction of the placement surface, and the second position being a position where the protruding portion of the drawing tool fits in the groove portion to set the direction of the first axis of the tip portion to the second tilt direction in which the first axis is tilted to the other side in the one direction from the vertical direction.

11. The drawing apparatus according to claim 9, wherein the first rotation mechanism is a rotation gear, and wherein the second rotation mechanism is provided within a movable range of the drawing tool and has a shape to be engaged with the rotation gear.

* * * * *